US006748955B2

(12) United States Patent
Snaidr et al.

(10) Patent No.: US 6,748,955 B2
(45) **Date of Patent: *Jun. 15, 2004**

(54) CIGARETTE SIDESTREAM SMOKE AND FREE-BURN RATE CONTROL DEVICE

(75) Inventors: Stanislav M. Snaidr, Mississauga (CA); Larry Bowen, Orangeville (CA); Warren A. Brackmann, Collins, MO (US)

(73) Assignee: Rothmans, Benson & Hedges Inc., Ontario (CA)

( * ) Notice: Subject to any disclaimer, the term of this patent is extended or adjusted under 35 U.S.C. 154(b) by 64 days.

This patent is subject to a terminal disclaimer.

(21) Appl. No.: 10/075,378

(22) Filed: Feb. 15, 2002

(65) Prior Publication Data

US 2002/0074010 A1 Jun. 20, 2002

Related U.S. Application Data

(62) Division of application No. 09/284,633, filed as application No. PCT/CA97/00762 on Oct. 15, 1997, now Pat. No. 6,371,127.

(60) Provisional application No. 60/037,562, filed on Feb. 11, 1997.

(30) Foreign Application Priority Data

Oct. 15, 1996 (GB) ..... 9621466

(51) Int. Cl.[7] ..... A24F 13/02

(52) U.S. Cl. ..... 131/175; 131/198.1; 131/174; 131/191; 131/202

(58) Field of Search ..... 131/198.1, 198.2, 131/175, 174, 189, 194, 191, 202, 212.2, 224, 228, 230, 237.5, 339, 368, 338, 336, 334, 207, 210, 331

(56) References Cited

U.S. PATENT DOCUMENTS

| | | | | |
|---|---|---|---|---|
| 2,499,733 A | | 3/1950 | Di Rubbio | |
| 2,541,837 A | | 1/1951 | Schroff | |
| 3,220,418 A | | 11/1965 | Cohn | |
| 3,250,280 A | | 5/1966 | Hu | |
| 3,502,087 A | | 3/1970 | Romano | |
| 3,916,916 A | | 11/1975 | Bramucci | |
| 3,991,773 A | | 11/1976 | Walker | |
| 4,585,014 A | | 4/1986 | Fry | |
| 4,685,477 A | | 8/1987 | Valdez | |
| 4,852,590 A | * | 8/1989 | Ferka | 131/210 |
| 4,915,117 A | | 4/1990 | Ito | |
| 5,040,551 A | | 8/1991 | Schlatter et al. | |
| 5,105,838 A | | 4/1992 | White | |
| 5,592,955 A | | 1/1997 | Keritsis | |
| 6,371,127 B1 | * | 4/2002 | Snaidr et al. | 131/198.1 |

FOREIGN PATENT DOCUMENTS

| | | |
|---|---|---|
| FR | 1583284 | 10/1969 |
| GB | 928 089 | 6/1963 |
| WO | WO 95 34226 | 12/1995 |
| WO | WO 96/22031 | 7/1996 |

OTHER PUBLICATIONS

PCT/CA97/00762 International Search Report dated Apr. 2, 1998.

* cited by examiner

*Primary Examiner*—Dionne A. Walls
(74) *Attorney, Agent, or Firm*—Banner & Witcoff, Ltd.

(57) ABSTRACT

A device for minimizing cigarette sidestream smoke and reducing free-burn rate of a burning cigarette is disclosed. The device comprises a non-combustible tubular element encasing an effective length of a tobacco charge of a cigarette located in the tubular element. The tubular element minimizes sidestream smoke emission from a burning tobacco charge and reduces free-burn rate of such burning tobacco charge to increase the number of puffs from the burning tobacco charge.

9 Claims, 9 Drawing Sheets

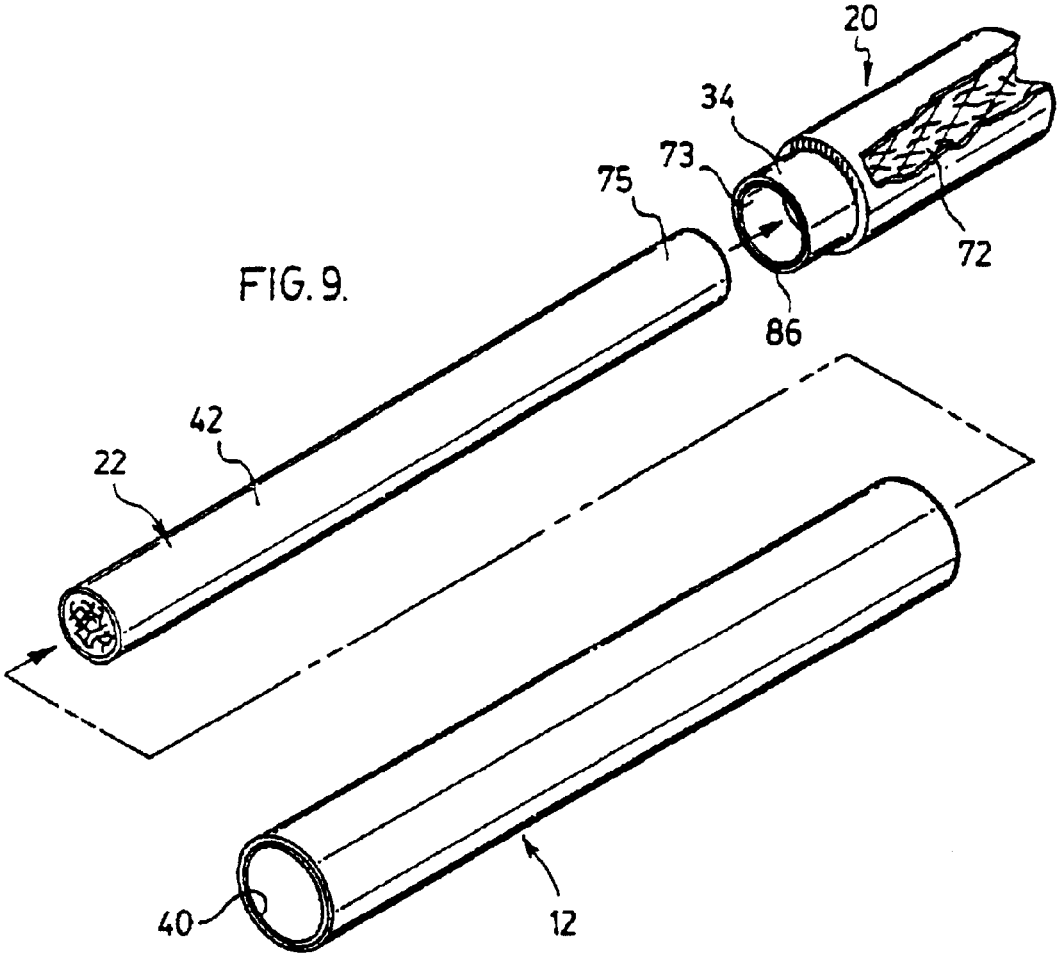
FIG. 9.
FIG. 10.
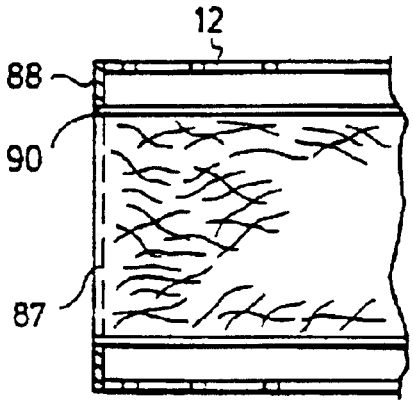
FIG. 11.
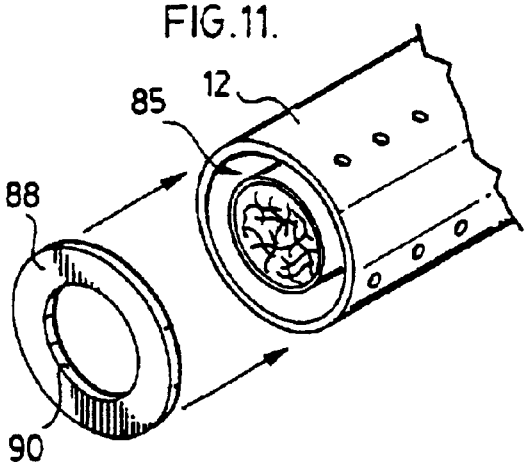

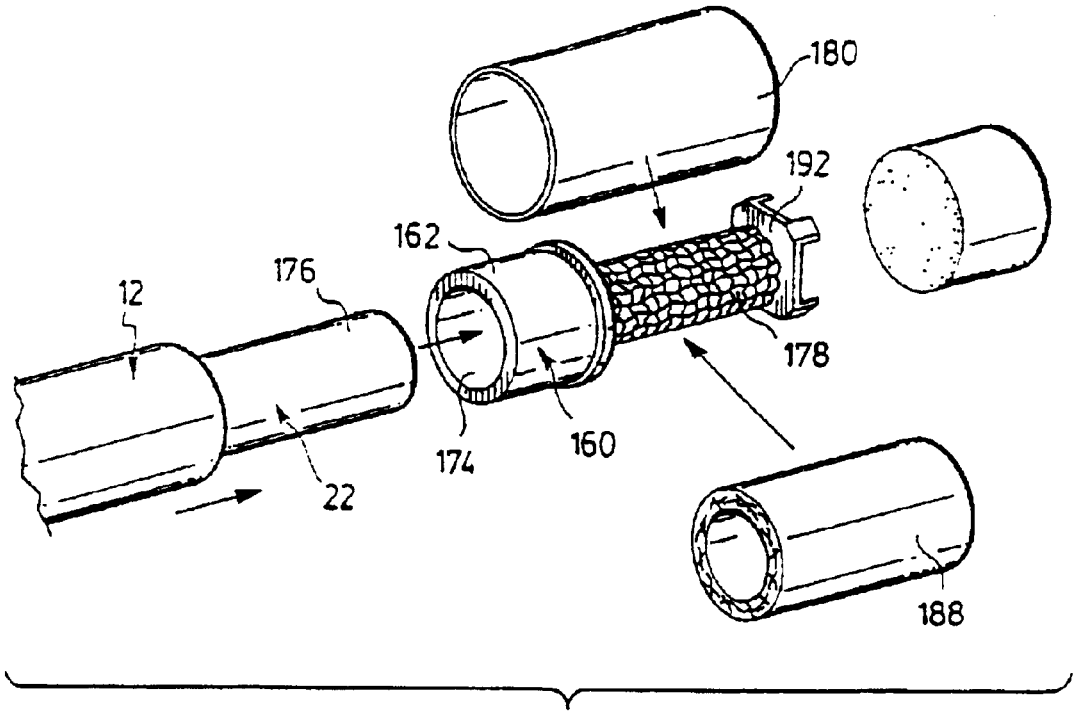
FIG.23.
FIG. 24
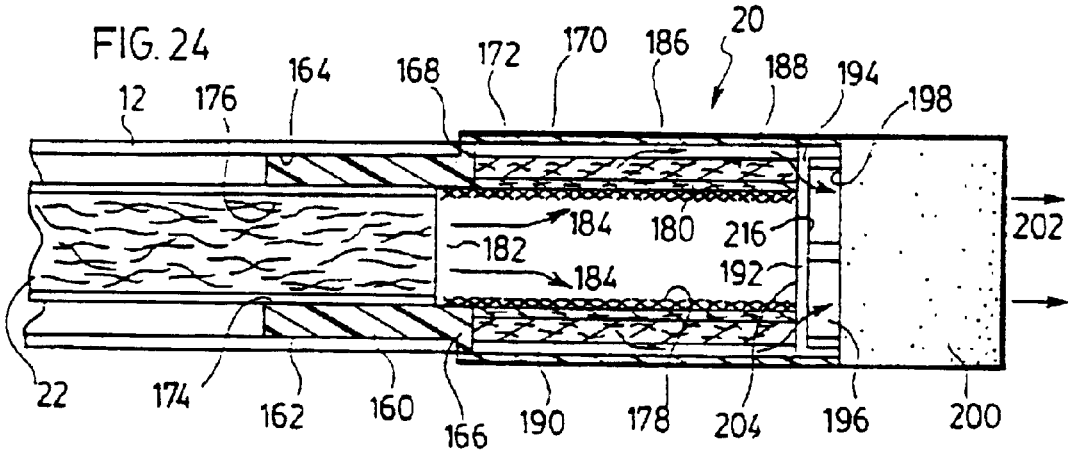

CIGARETTE SIDESTREAM SMOKE AND FREE-BURN RATE CONTROL DEVICE

RELATED APPLICATIONS

This application is a divisional of U.S. Ser. No. 09/284,633 filed Apr. 15, 1999, now U.S. Pat. No. 6,371,127 which is 371 application of PCT/CA97/00762 filed Oct. 15, 1997 and published under PCT Article 21(2) in English.

SCOPE OF THE INVENTION

The invention relates generally to an apparatus which is to be used in combination with a cigarette or other tobacco product to control sidestream smoke and increase the numer of puffs available to the smoker from a given amount of tobacco. The apparatus will permit, for instance, using only as much tobacco as necessary to deliver in a much thinner cigarette of lesser diameter, an increased yield of mainstream smoke from the burning tobacco and conventional taste while significantly reducing sidestream smoke. Unlike a conventional sigarette which involves considerable tobacco waste as the thicker cigarette is burned to produce sidestream smoke, the use of the thinner cigarette with this apparatus converts what would be normally tobacco wasted on sidestream smoke into mainstream smoke.

Simply stated, the apparatus includes a tube having a predetermined porosity into which a tobacco product, such as a cigarette is inserted. Preferably, there is a space between the outside of the cigarette and the inside of the tube. The porosity of the tube is carefully selected to achieve sidestream smoke reduction and reduction of free-burn rate between puffs. A very thin cigarette may be inserted and smoked for the same number of puffs as a conventional cigarette, with the resultant saving of tobacco and other cigarette materials and a significant reduction of sidestream smoke. The tube may include a catalytic material to treat sidestream smoke constituents.

The apparatus will be discussed in greater detail and can be used in various different ways, for instance, rather than a cigarette, a tobacco charge that cannot be separately smoked, is inserted and, by controlling the holes and porosity of the tube, could be smoked. It is apparent that all the conventional quality requirements in making a cigarette, such as, firmness and end fallout are no longer of priority with this invention.

While the apparatus could be sized for use with a conventional cigarette, an advantage is that a thin cigarette can be inserted and smoked with the same smoking characteristics as if it were a conventional sized cigarette.

BACKGROUND OF THE INVENTION

When smoking in a conventional manner, there is generally understood to be three types of cigarette smoke, mainstream smoke, exhaled smoke and sidestream smoke. There has been significant interest in reducing the amount of sidestream smoke emitted by a burning cigarette or cigar because it accounts for the majority of smoke emitted during the smoking process. Attempts have been made to control sidestream smoke by one or more of the following techniques:

1) alter the tobacco composition and packing characteristics of the tobacco rod or charge in the cigarette or cigar;
2) alter the wrapping for the cigarette or cigar;
3) alter the diameter of the cigarette as well as its tobacco composition; and/or 4) provide a device on the cigarette or cigar to contain and/or contaol sidestream smoke emissions.

Various cigarette tobacco and cigarette paper formulations have been suggested which in one way or another affect the free-burn rate of the cigarette or cigar with a view to reducing sidestream smoke and/or achieving an extinguishment of the lit cigarette or cigar when left idle over an extended period of time. Such designs include a judicious selection of tobacco blends, density and multiple layers of cigarette tobacco in the tobacco charge. Such selected designs can appreciably retard the free-burn rate of the cigarette and hence, increase the number of puffs obtained per unit length of cigarette. Either in combination with tobacco selection and/or construction or independently of the tobacco make up, various cigarette paper compositions can also affect free-burn rate of the cigarette. Such paper compositions include the use of chemicals to retard free-burn rate, multiple wrappings of different types of cigarette paper of the same or different characteristics and reduction of air permeability. See for example, Canadian Patent 1,259,008 and U.S. Pat. Nos. 4,878,507 and 4,915,117.

Various devices have been provided which contain the cigarette, primarily for purposes of preventing accidental fires. They may or may not at the same time include various types of filters to filter and thereby reduce the amount of sidestream smoke. Examples of such devices are shown in U.S. Pat. Nos. 1,211,071; 3,827,444 and 4,685,477.

Further, various types of cigarette holders have been made available which service the primary feature of minimizing staining of the smoker's fingers. Such devices may be connected to the cigarette tip and/or mounted on the cigarette, such as shown in U.S. Pat. No. 1,862,679. Other types of cigarettes which are enclosed in wrappers which are perforated in one way or another to provide for safety features and/or control of sidestream smoke are described in Canadian Patent 835,684 and U.S. Pat. Nos. 3,220,418 and 5,271,419.

Devices which are mountable on the cigarette and which may be slid along the cigarette to control combustion and hence free-burn rate are described in U.K. Patent 928,089; U.S. Pat. No. 4,638,819 and International application WO96/22031. The U.K. patent describes a combustion control device for cigarettes by limiting the flow of air to the cigarette burning ember. By retarding combustion of the cigarette, it is suggested that only half of the conventional amount of tobacco need be incorporated in the cigarette and result thereby in a shorter cigarette. The air flow limiting device may be provided by an array of apertures in the device with variable opening or by crimped portions in the device providing longitudinal openings along part of the cigarette. U.S. Pat. No. 4,638,819 describes a ring which is placed on the cigarette and slid therealong during the smoking process to control the free-burn rate of the cigarette and reduce sidestream smoke. The ring is of solid material, preferably metal, which causes considerable staining and due to variable cigarette diameters cannot reliably provide the desired degree of sidestream smoke reduction and extinguishing times.

An alternative ring system is described in applicant's published PCT application WO 96/22031. The device is provided with an inner ring which surrounds and contacts a conventional cigarette perimeter where the inner ring is of porous material. The outer ring encases the inner ring to direct air flow along the length dimension of the porous inner ring. The tortuous paths in the porous material of the inner ring controls the rate of air diffusion to the lit cigarette coal and thereby controls the free-burn rate of the cigarette.

The porous material enhances the control of sidestream smoke emitted by the lit cigarette. The device may optionally extend up to one-half the length of the cigarette where air would have to flow along the inner porous ring to the burning coal.

Other systems which have been designed to control sidestream smoke are described in published PCT application WO 95/34226 and U.S. Pat. No. 5,592,955 issued Jan. 14, 1997 and U.S. Pat. No. 5,105,838 issued Apr. 21, 1992. These references describe various tubular configurations in which a tobacco element is placed in an attempt to minimize cigarette sidestream emission.

Although these approaches may have met with various degrees of success, in controlling sidestream smoke emissions, there are problems with some of the devices in providing conventional taste and flavour, ease of use, ease of manufacture, streamline appearance and significant reductions in the amount of tobacco used. The various embodiments of this invention provide a device which overcomes a number of the above problems by controlling both sidestream smoke and free-burn rate while achieving taste, flavour and constituent deliveries comparable to conventional cigarettes. The device of this invention permits the smoking of a thinner cigarette which has only as much tobacco as is necessary to deliver the desired taste while achieving the conventional number of puffs.

In order to facilitate the description of the invention, the term tobacco charge shall be used in referencing a cigarette, cigar, cigarillo, tobacco rod in a porous mesh, a tobacco plug or wrapped tobacco or the like. It is also understood that where the term cigarette is used, it is interchangeable with cigar, cigarillo and the like.

SUMMARY OF THE INVENTION

In accordance with an aspect of the invention, a device for minimizing cigarette sidestream smoke and reducing free-burn rate of a burning cigarette in combination with a filter tip, A) said device comprising:

i) a non-combustible porous tubular element encasing an effective length of a tobacco charge of a cigarette located in said tubular element, said tubular element having an open end adjacent a distal end of said cigarette to permit lighting of the cigarette distal end and to permit ingress of air; and ii) said tubular element having a predetermined porosity along at least its length which encases said effective length of said tobacco charge for both minimizing sidestream smoke emission from a burning tobacco charge and reducing free-burn rate of such burning tobacco charge to increase number of puffs from such burning tobacco charge, where said predetermined porosity for said tubular element:

a) retains around a burning ember of said cigarette oxygen deprived combustion gases within said tubular element to reduce rate of combustion and minimizes release of smoke particles through said porous tubular element; and b) restricts inward flow of air to reduce free-burn rate of said cigarette; and B) said filter tip comprising an inlet end and an outlet end, said inlet end having an annular sleeve with a central bore to receive an end of said cigarette, said annular sleeve having an outer shoulder onto which said tubular element is friction fitted, said central bore being in communication with a first inner tube of a first filter material, said tube having a closed end opposite its end in communication with said sleeve central bore, an annular space being provided outside of said first tube, a filter plug provided downstream of said annular space and filling said outlet end of said filter tip, a plenum between said filter plug and said first tube for transferring filter smoke from said annular space to said filter plug.

The openings in the tubular element in forming the predetermined porosity may take on various shapes such as narrow slits, slots or pores where the slits and/or slots may be covered with a porous matt of carbon fibre, glass fibre, ceramic fibre, high temperature plastic fibre, metal fibre and the like. The pores may be fabricated in the tubular wall of the element such as by punching to form fibrous projections within the tube where such projections may be relied on to center a cigarette in the tubular element. Alternatively, the tubular element may comprise a body portion of porous materials which perform the functions of retaining at least some of the oxygen deprived combusion gases within the tube and restrict inward flow of air to reduce free-burn rate of the cigarette.

In accordance with another alternative, the tubular element may be of a heat treated ceramic material which is rendered porous by the heat treatment. The makeup of the ceramic precursor material and the heat treating are carried out in a manner to provide the desired predetermined porosity.

In any of the above devices it is understood that the cigarette may be sufficiently thin to provide an overall dimension for the device which is that of a normal cigarette. The thin cigarette may have a diameter ranging from about 4 to 8 mm and preferably, about 4 to 6 mm and most desirably, about 4 mm. A catalytic material may be incorporated in the tubular element particularly when formed from ceramic. The catalytic material may either be coated on the tubular element or may be activated in the tubular element during heat treating of the ceramic precursor. The catalyst may be selected from a variety of well known groups including those which are based on precious metals and rare earth metals and in particular, based on platinum or cerium.

BRIEF DESCRIPTION OF THE DRAWINGS

Various aspects of the invention are shown in the drawings wherein:

FIG. 9 is an exploded view of an alternate device;

FIG. 10 is a section of an end of the device;

FIG. 11 is an exploded end view of the device of FIG. 10;

FIG. 23 is an exploded view of an alternative embodiment for the filter tip;

FIG. 24 is a section through the assembled device of FIG. 23; and

DETAILED DESCRIPTION OF THE PREFERRED EMBODIMENTS

Figure 1:
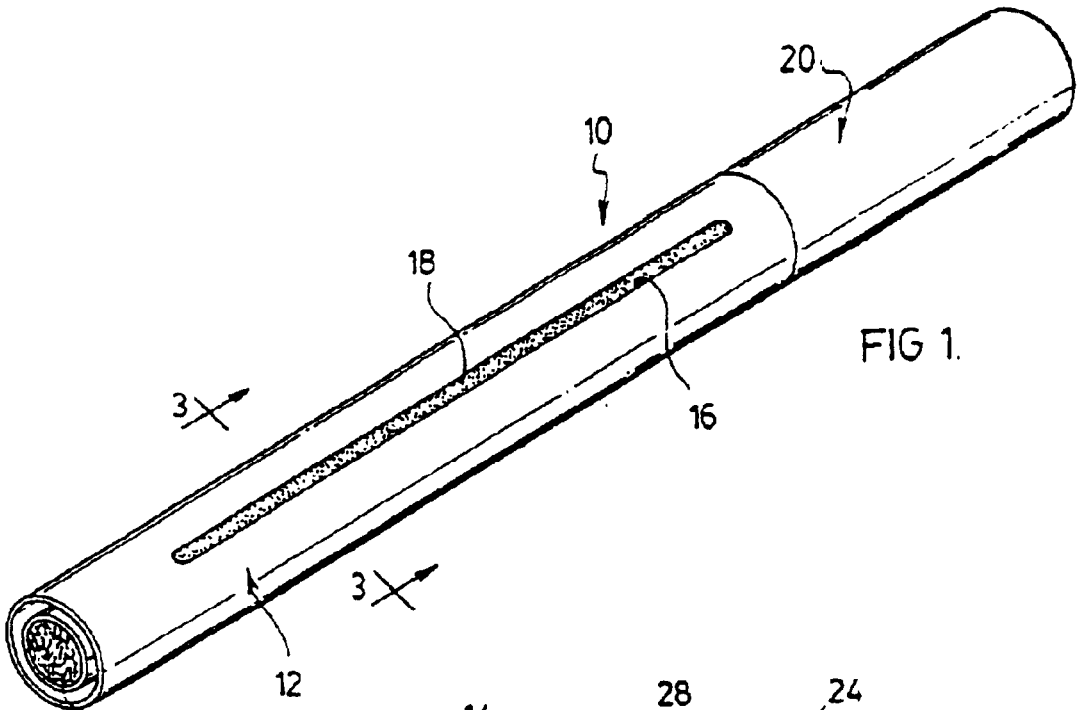
FIG. 1 is a perspective view of the preferred embodiment of this invention showing the device in which a cigarette tobacco charge is encased.

The device in accordance with this invention for minimizing sidestream smoke from a tobacco charge such as in a cigarette while controlling free-burn rate, has many features and advantages. The device, which in essence by encasing a tobacco charge, has a low ignition propensity to provide significant safety features should the lit charge be accidentally set down on ignitable materials. The device minimizes sidestream smoke emitted from the tobacco charge due in part to the free-burn rate control aspect of the device. This device has the surprising benefit of providing sidestream smoke control and free-burn rate control while encasing the tobacco charge, yet is capable at the same time of providing all of the normal features in smoking a conventional cigarette such as appearance, feel, taste and flavour. Catalytic materials may be incorporated in or coated on the device to promote further combustion of various gases to avoid any off smell from the device as a cigarette is burning therein.

The device also permits the use of a non-conventional thin cigarette which is considerably thinner than a conventional cigarette and may contain up to ⅔ less tobacco in the tobacco charge, hence, very significant tobacco and material cost savings in the manufacture of cigarettes to be used with the device. More particularly, a very thin or slim cigarette which is non-conventional in the reduced number of puffs and involving significantly ⅔ less tobacco, may be used. The device with the thin non-conventional cigarette provides the smoker with normal inhale pressures, normal quantities of inhaled smoke, normal flavour and taste and normal number of puffs. The thin non-conventional cigarette cannot offer all of these features together if smoked without the device.

An unexpected advantage which flows from the use of a thin non-conventional cigarette for use in this device is that the smaller diameter of the thin cigarette ensures proper burning during the idle phase to avoid off-taste. The device in controlling free-burn rate ensures that the lit cigarette during the idle phase considerably slows down the rate of advance of the burning coal. By virtue of the smaller diameter for the thin non-conventional cigarette, the burning coal extends across the face or the cross-section of the smaller diameter cigarette. This is quite different from what happens with a conventional size cigarette when the free-burn rate is controlled. In a conventional cigarette, due to the excessive amount of tobacco in the larger cross-section, the coal burns inwardly of the cigarette central portion during the idle phase and allows condensation of smoke products in the outer portion of the cigarette. This would appear to be a particular result when the prior art types of free-burn rate control devices are used. Unlike that arrangement, the arrangement according to a preferred embodiment of this invention which involves the thin non-conventional cigarette, is that the coal as it extends across the face, ensures proper burning even during the idle phase so that combustion products do not condense in the outer portion of the slim cigarette. When the cigarette is then picked up again for the next puff, the inhale step causes the coal to rise immediately to temperature and advance quickly along the thin cigarette thereby avoiding any off-taste because the coal is immediately up to normal smoking temperature. It is also a feature of the invention, that the thin non-conventional cigarette may be thinner than the normal slim cigarette of about 5.5 mm to 6 mm. The non-conventional cigarette is a novel structure in the marketplace when its diameter is less than 5.5 mm and particularly when less than 5.2 mm. The thin cigarette as preferably used in the device, is non-conventional in terms of number of puffs and size. The size is not only different in respect of diameter but possibly the length as well. The thin cigarette as with a conventional cigarette, has a suitable wrapping which is ideally the usual form of cigarette paper having the usual composition and porosity. The paper may also include common burn rate modifiers to further retard the free-burn rate of the cigarette such as the burn rate modifiers described in U.S. Pat. No. 4,679,575.

A further significant benefit which flows from the use of a thin cigarette in the device is that the excessive tobacco in a conventional sized cigarette burns off as sidestream smoke. With the free-burn rate control of this device, there is minimal waste of tobacco during the idle phase. Instead, what would have been waste in providing sidestream smoke, during the idle phase of a conventional cigarette becomes mainstream smoke on the next puff thereby increasing yield per unit of tobacco.

Some or all of the features of this invention may be attained by one or more of the following embodiments of the invention, as particularly described with reference to the drawings. In FIG. 1, the device 10 has a tubular element 12 for encasing a cigarette 14. The device 12 extends over the effective length of a tobacco charge for the cigarette. Effective portion of the tobacco charge of the cigarette is intended to include the length of a cigarette which would be normally smoked in order for the smoker to achieve the usual number of puffs (normally eight to ten) as per a conventional cigarette. The device 12, in accordance with this particular embodiment has several openings 16 in its periphery, one of which is shown in FIG. 1. The opening 16 is preferably a slit extending longitudinally of the device 10. The opening of the slit 16 supplies air to the burning cigarette to support combustion where along the length of the opening, a component 18 is provided for effecting free-burn rate control while achieving in the same device, that is, simultaneously minimization of the sidestream smoke emitted from the burning cigarette. In conforming with a conventional cigarette, the tubular element 12 has connected thereto or integrally formed therewith a filter tip portion 20 for purposes of filtering in the usual manner mainstream smoke inhaled from the burning cigarette.

Figure 2:
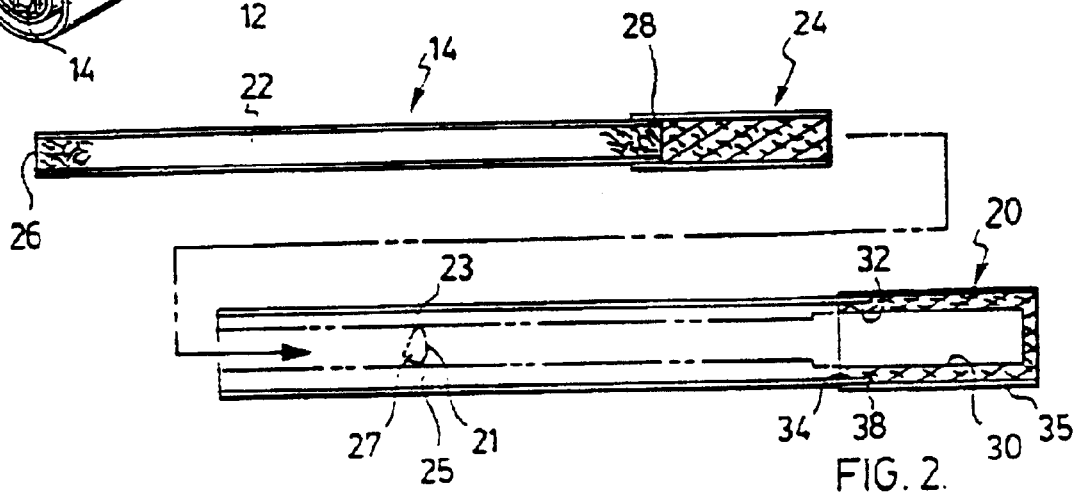
FIG. 2 is a section along the device of FIG. 1.

As shown in FIG. 2, the tubular device 12 encases the cigarette 14 which has a wrapped tobacco rod portion 22 and in accordance with this particular embodiment, a filter tip portion 24. The device 12 preferably extends from the distal end 26 of the tobacco rod 22 to at least the filter tip line 28. The slit 16 extends to at least the rearward portion of the effective length of the tobacco rod 22 to ensure that the cigarette continues to burn for at least the number of puffs associated with a conventional cigarette. The cigarette may then be extinguished by smoking the tobacco rod close to the filter tip line 28 or by virtue of the slit terminating forwardly of the tobacco line 28 so that insufficient air reaches the burning end portion of the cigarette and it extinguishes before reaching the filter tip line 28. The filter tip portion 20 has a bore 30 provided therein to receive snugly the filter tip 24 of the cigarette and thereby support the cigarette as it extends out from the tip 20. It is appreciated that the cigarette 14 may only have a wrapped tobacco rod 22 and no filter. In this arrangement, the tobacco rod end would be inserted in and supported by the filter tip 20. The bore 30 of tip 20, defines a blind hole, so that the hole does not extend through the tip 20. The tip 20 has a reduced neck portion 32 to define a land 34 over which the tubular element 12 is slid to provide the assembled unit of FIG. 2. Tipping paper 35 completes the assembly where the land portion 34 may be sealed to prevent air entering the tip 20 from the gap between cigarette and tube. With the inner edge 36 of the tubular element 12 contacting the abutment 38 of the tip 20, the assembled unit appears seamless and hence, resembles a conventional looking cigarette in the manner shown in FIG. 1.

Figure 3:
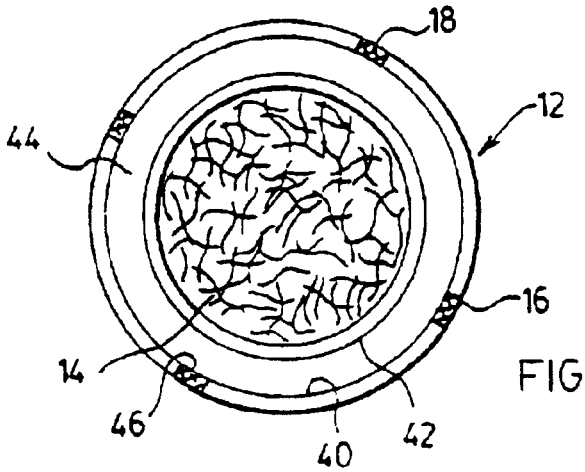
FIG. 3 is a section along the lines 3—3 of FIG. 1.

By virtue of the tip 20 supporting the cigarette, the tobacco rod portion 22 is positioned substantially concentrically within the tubular element 12. In accordance with this particular embodiment, the tubular element 12, as shown in FIG. 3, has an inside diameter defined by the interior surface 40 which is spaced from the exterior surface 42 of the cigarette paper periphery. Such spacing defines an annulus or gap 44 extending along the length of the device 10 to the connection of the tubular element 12 with the device tip 20. The annulus 44 in conjunction with the component 18 in the opening 16, perform in combination the control aspects required in minimizing sidestream smoke and reducing free-burn rate of the cigarette.

The tubular element 12 is formed of a cigarette smoke impervious material. In order to maintain the structural integrity of the tubular element 12 during the smoking process, the material is non-combustible and is able to withstand the temperatures of a burning coal receding inward along the tubular element during the smoking process. Similarly, the component 18 in the openings 16 is non-combustible to ensure all aspects of sidestream smoke control and free-burn rate control are achieved while smoking the cigarette. The non-combustible aspect of the tubular element 12 also permits re-use of the device for smoking a package of cigarettes, by simply removing the tubular element 12 from the tip 20 and withdrawing the cigarette 14 from the tip 20. The device is then ready for re-use by inserting a fresh cigarette 14 in the tip 20 and re-assembling the tubular element 12 on the tip 20. It is understood of course that all cigarettes in the package may come equipped with the device 10 and simply discard the unit when the cigarette is smoked.

As shown in the enlarged view of FIG. 3, the slit 16 defines an opening 46 having the component 18 provided therein to effect control of the cigarette free-burn rate and minimize sidestream smoke. Depending upon the shape and size of the slits 16, a sufficient number are provided along the tubular element 12 to ensure with the components 18 in place that sufficient air reaches the effective portion of a tobacco rod to maintain the desired free-burn rate in providing the usual number of puffs equivalent to a conventional cigarette. The component 18 is preferably of a porous material which is non-combustible. The porous material may be formed from carbon fibre, preferably activated carbon fibre, ceramic fibre, glass fibre, high temperature plastic fibre, metal fibre, synthetic wood derived materials of a porous nature (briar wood) and the like. The fibres may be in long strand form or may also be matted or in some way formed into a matt or sheet and rendered porous by physically making minute pores in the material, (i.e., by laser drilling, by chemical leaching of soluble minute particulars from matt or mild calcining to remove combustibles from the material).

The porous material may be in the form of a matt or sheet and may be woven to provide a degree of porosity which for the number and size of selected slits 16, provides the necessary control in achieving the desired free-burn rate of the cigarette. The placement of component 18 which may be the porous woven or non-woven, matt or sheet of non-combustible material may be just in the slit 16 as shown. This may be done by dipping the tubular member 12 in a slurry of the fibrous material, which is used to form the matt. Preferably the fibrous material is activated carbon fibre in an aqueous slurry optionally in combination with a suitable binder and possibly catalytic materials. Once the slurry has dried and thereby filling the slits 16, any excess is removed from the interior surface 40 of the tubular member 12.

Figures 4, 5:
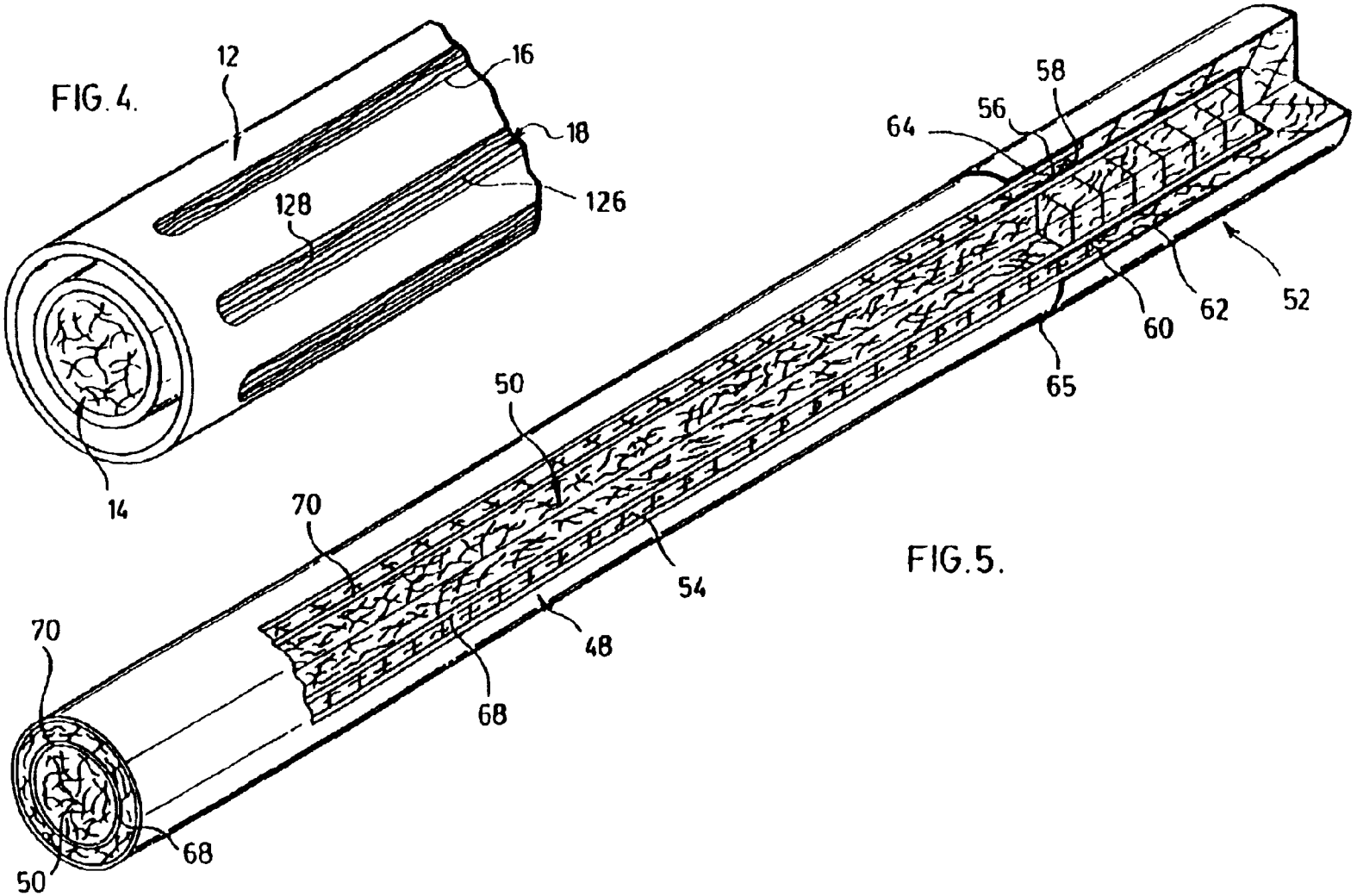
FIG. 4 is the enlarged view of an end view of the device.
FIG. 5 is a perspective view of an alternative embodiment of this invention showing the device encasing a tobacco charge of a cigarette.

The porous material for the slits may be long strands positioned within the slits instead of being matted or woven into a sheet. This alternative embodiment as it would apply to longitudinally extending slits in the tubular member is shown in FIG. 4. The tubular element 12 has the longitudinally extending slits 16 filled with a porous material 18 as in the earlier described embodiment of FIG. 1. The difference however is the composition for the fibrous material 18, as shown in more detail in FIG. 4. Instead of a matting, as described with respect to FIG. 3, the fibrous material is in the form of longitudinally extending strands 126 which extend along the length of the slit 16. The strands of material may be of glass, plastic, metal or carbon fibre and the like. Preferably, the strands 126 are of an activated carbon fibre. A sufficient number of strands are located within the slit 16 to define spaces or in essence very long and narrow pores 128 between the strands which perform the necessary dual function of sidestream smoke control and free-burn rate control. Preferably, the strands are of hair-like diameter in order to increase the number which may be provided in the slits and at the same time significantly increasing surface area for the fibrous material to work on the sidestream smoke control while providing an acceptable pressure drop to simulate normal inhale pressures on cigarette. The strands are located along the slit and may be secured at various intervals along the slit to ensure that the strands do not fall out of the slit during packaging or use.

The conventional wisdom in respect of free-burn rate control is to restrict the flow of air to the burning coal of a lit cigarette. By restricting air flow, the free-burn rate of the cigarette is reduced because rate of combustion is retarded. Although this approach has been successful in controlling free-burn rate, such devices may restrict the flow of air when the smoker draws on the cigarette.

The device in accordance with this invention would not however appear to be functioning in a conventional manner for controlling free-burn rate. Although the porous material 18 and/or slits 16 sizing may restrict air flow, the porosity and pore size may be selected such that at least some of the hot oxygen deprived gases of combustion are retained by the tubular element 12 in the annulus region 44 of the burning ember. As shown in FIG. 2, the burning cigarette has an ember or coal 21 receding in tube 12 to the position shown in dot. The usual ash cone 27 is behind the advancing ember 21. The hot combustion gases are located in the annulus or gap 44 as developed by the burning ember such as indicated at 23 and 25 above, below and around the cigarette. At least some, if not substantially all or a majority of the hot gases retained in regions 23 and 25 around the burning ember 21, is believed due to the selected porosity of the openings 16 and/or the porous material 18. In controlling sidestream smoke, the porosity and pore sizing is selected to retain preferably a major portion, if not substantially all the hot gases and thereby develop in the region of the ember 21 an oxygen deprived gas. The porosity of the tubular element 12 not only restricts air flow, but as well is believed to contain the hot oxygen deprived combustion gas and thereby starve the burning ember and reduce rate of combustion and hence retard free-burn rate of the cigarette. The porosity of the material is selected to ensure that flow of air into the tube during the idle phase of the cigarette is minimal. This action maintains the level of oxygen deprived gases in the region of the burning coal and thereby keeps the free-burn rate of the cigarette at the desired minimum burn rate. When a smoker draws on the device, air is drawn in through the openings and/or porous material in the tubular element as well through the open end to supply the needed air to support burning during the puff phase. Once the smoker stops drawing on the cigarette, the contained oxygen deprived combustion gases in the region of the burning ember immediately retard rate of combustion and thereby reduce free-burn rate. With this guidance, it is appreciated that the pore sizing in the tube may vary depending on a number of factors including type of tube material physical properties, composition and type of pore openings. It has been demonstrated on a repeated basis that some testing may be required in selecting various pore sizings which provide the necessary tube porosity for controlling free-burn rate and sidestream smoke.

This approach to controlling free-burn rate is quite different from many of the prior art devices which are primarily focused on controlling air flow to the burning ember. The device in accordance with this invention retains the developed hot gases in the region of the burning ember by providing an enlarged region in the annulus to contain the larger volume of hot gases compared to the smaller volume of fresh air needed to support combustion. By providing an annulus of open space or filled with porous material, as will be described with respect to FIG. 5, minimal but sufficient volumes of air to support and maintain minimal combustion during free-burn and commencement of puffing on the cigarette are provided. As the puff on the cigarette continues, additional air is drawn through the tubular element openings and also through the tubular element open end.

The porous material also has the capability of adsorbing or absorbing various particulate components and aerosol of the sidestream smoke and capturing such material so that in the event the device is re-used the captured smoke particulates are not released to affect the flavour and taste of a replaced new cigarette to be smoked. The preferred carbon material for the porous material is commonly sold in the form of a mat or sheet which may be matted or woven and thereby facilitates its application to slits 16 in the device 12. The carbon fibre material may cover the entirety of the tube interior or just cover the slits. Alternatively, the long strands of carbon fibre may be located in and along the slits 16 in a manner to be described with respect to FIG. 4.

It is appreciated that the openings formed in the tubular element of the embodiment of FIG. 1 may be formed therein by laser cutting, high speed saw cutting, stamping, punching, piercing and the like. The porous component 18 may be applied to the openings by dipping the tubular element in a slurry of the fibrous material to form a porous fibrous matt in the openings. When the slurry is dried within the tubular element, excess fibrous material within the tubular element may be removed. It is also understood that fibrous material may be precisely positioned in the slit 16 and heated with a laser beam somewhat similar to the manner in which laser printing is accomplished on paper.

The tubular element 12 is formed of a non-combustible material which may preferably be a ceramic, high temperature plastic, treated paper or porcelain paper, synthetic porous wood derived materials or sheet rolled and secured to form the desired size for the tubular element. The interior may be coated with catalytic particles to catalyze oxidation of carbon and nitrogen containing gases given off from the primary burning of tobacco. Preferably, the exterior of the tubular element 12 is white to resemble cigarette paper or when used on a cigar, is a tan colour to resemble a cigar wrapper. Alternatively, the tubular member could be wrapped in a cigarette paper of sufficient porosity. The tip 20 may be a normally constructed filter element of a conventional cigarette with sufficient structural integrity to maintain the bore 30 therein to receive the tip portion 24 of the cigarette 14. The tip portion 20 may be wrapped in a suitable paper or like material so that the assembled unit of FIG. 1 looks like a conventional cigarette. It is appreciated that the tip portion 20, when used with a cigar, may be formed to look like the conventional tip of a cigar or the conventional mouthpiece commonly used with cigars.

The further embodiment of the invention, as shown in FIG. 5 demonstrates an alternative arrangement for the tubular element 48 of the device 10. The tubular element 48 encases a cigarette 50 and has a suitable tip 52. The tubular element 48 is formed from a substantial thickness of non-combustible porous flexible material. The thickness of the porous material is considerably thicker than the thickness of the porous material used in component 18 of the embodiment of FIG. 1. The porous material may be of the same makeup as the material of component 18. It may be a sheet or a matt, with pores formed therein or a matted or woven carbon fibre, preferably activated carbon fibre, glass fibre, ceramic fibre, high temperature plastic fibre, metal fibre and the like and may optionally include catalytic particles to enhance continued combustion of gas from the burning tobacco. The tubular component has the porous material 54 extending the length of the tubular element 48 to the filter tip line 56 of the tip 52. The porous material, as with the embodiment of FIG. 1, extends along the tubular element for the effective length of the tobacco rod to be smoked so as to simulate the same conditions in smoking a conventional cigarette. The tip 52 is constructed in a manner similar to the tip 20 of FIG. 1. The tip 52 has a red portion 58 defining a land 60 with an abutment or stop 62. The tubular element 48 has an end portion 64 and is dimensioned to abut the land 60. Tipping paper 65 is used in the conventional manner to complete assembling of the tubular element 48 to the tip 52. The cigarette 50 fits within the bore 66 in a manner described with respect to FIG. 2. The cigarette 50 is then supported by the tip 52, where such support is enhanced by the tubular element 48 contacting or engaging cigarette periphery. This aspect also permits the manufacture of a cigarette which does not have all the usual characteristics of a conventional cigarette, such as, firmness, strength, end fallout and the like. The same may apply to the device of FIG. 2 because the cigarette is housed in the tubular element and is thereby protected and not subject to constant tapping to remove ash as would be the case if the cigarette were smoked apart from the device. It is also understood that the tubular element of FIG. 2 may have internal ribs to support the cigarette concentrically in the tube. The device of this invention allows for the use of a cigarette which may be made in a somewhat non-conventional manner. A number of the standard production processes may be avoided, such as, use of expanded tobacco, shredded or enhanced stem and the like which were required to provide desired cigarette firmness and appearance. Furthermore, the thin cigarette may be made with less tobacco in total and thereby requires considerably less quality tobacco.

As shown in FIG. 5, the tubular element 48 has an internal diameter defined by interior surface 68 which is essentially the same as the external diameter of the periphery 70 of the cigarette 50. The tubular element 48 is then slid over the cigarette 50 where the periphery of the cigarette is in essence in contact with the interior surface of the tubular element 48. The tubular element 48, in being made of non-combustible material retains its structural integrity as the cigarette is smoked and recedes within the tubular element. The tubular element 48 simultaneously minimizes sidestream smoke from the burning cigarette as well as controlling the free-burn rate of the cigarette. Such retention of the sidestream smoke in the tube is achieved by the porous material absorbing and capturing the smoked particles and aerosols of the sidestream smoke. In addition, if catalytic particles are embedded in the porous tubular material, the odour causing constituents of the aerosols may be oxidized into odourless constituent or pleasant smelling constituents.

The porous material is of a structure in the form of a mat or sheet or the like which is capable of capturing such particles and aerosol and retaining them so that they are not released during the smoking of a new cigarette in the device in the event that the device is re-used. Furthermore, the porosity of the porous material is selected to control air flow and retain hot combustion gases in the region of the burning cigarette ember to achieve the desired reduction in free-burn rate so that smoking of the cigarette simulates the number of puffs associated with smoking of a conventional cigarette.

The tubular element 48 may be formed from a single sheet or mat. Alternatively, the tubular element 48 may be formed by layering several sheets or thin mats of the porous material to form the desired thickness for the tubular element. The tubular element may include an outer coating or wrapper such that the exterior of the tubular element resembles in colour, a cigarette or cigar. It is appreciated that such coating or wrapping must be porous to the extent that it does not appreciably interfere with the control that the porosity of the tubular element 48 provides in achieving the desired free burn rate and sidestream smoke control. Other types of exterior coverings are described with respect to FIGS. 12 and 13.

Figure 6:
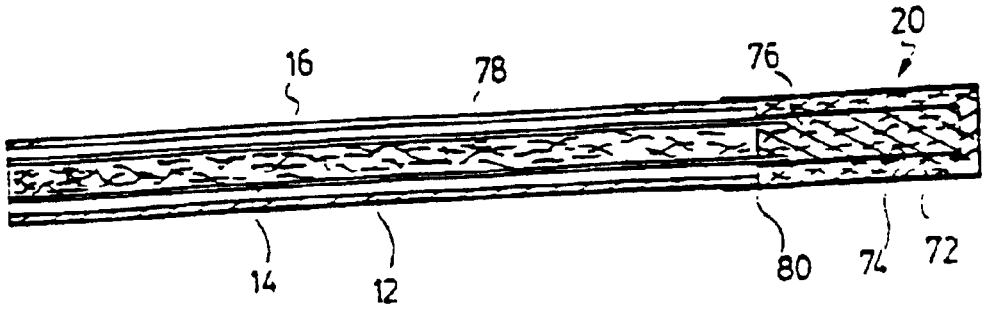
FIG. 6 is a section along an alternate device.

The tubular element 12 of the embodiment of FIG. 6 has openings for controlling free-burn rate and sidestream smoke reduction. By selecting an appropriate opening size, such as width of slit 16 and providing a suitably sized annulus 44, acceptable degree of sidestream smoke control and free-burn rate control can be achieved. The degree of sidestream smoke reduction is not as complete as compared to the device with component 18 in the slits 16. The size of the slit is smaller than slit 16 of FIG. 1 for controlling the rate of air flow into the annulus 44. It is appreciated that the openings provided in the tube may also be pores which are preferably circular. The openings are precisely formed in the tube to provide the necessary reduced size of opening to achieve free-burn rate control. The openings may be formed in the tube by laser drilling or the like where it is understood that the opening size may permit some sidestream smoke to pass, but the openings will still provide a very substantial reduction in released sidestream smoke. FIG. 6 also demonstrates the permanent attachment of the tip 20 to the tubular device 12. The tip 20 may include an annular filter-like component 72 which has a bore 74 therein to receive the filter portion 76 of the cigarette 78. The annular component 72 is then secured to the tubular member 12 by a suitable tip wrapping 80 which thereby gives the appearance of a finished cigarette and permanently connects the tip 20 to the tubular member 12.

Figure 7:
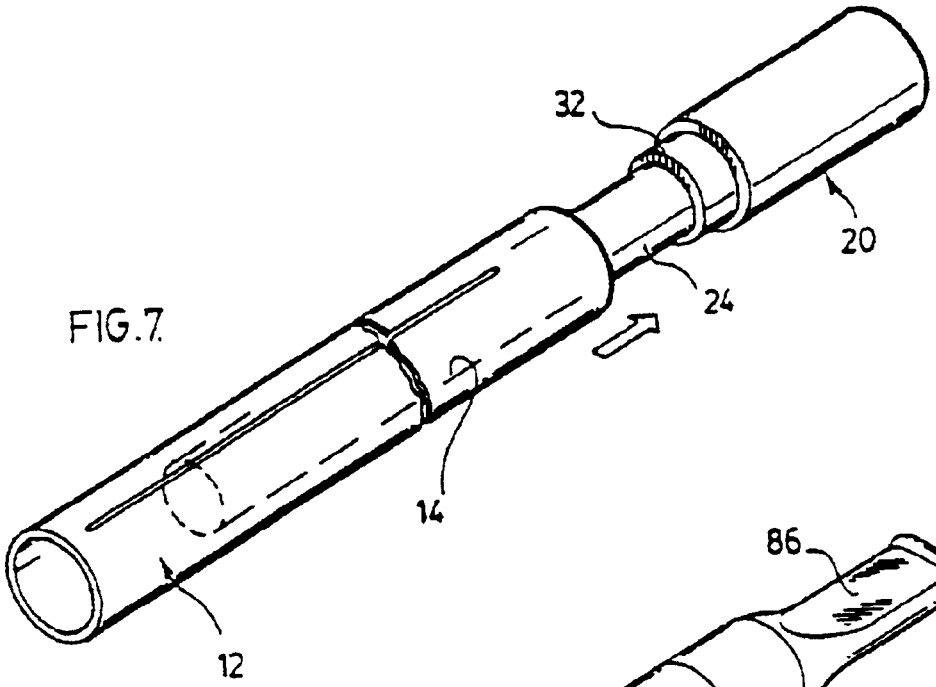
FIG. 7 is an exploded view of the reusable device.

FIG. 7 shows an exploded view of the device of FIG. 1 where the tip 20 can be removed from the tubular member 12 to expose the cigarette 14 and allow withdrawal of its filter portion from the tip 20. A new cigarette has its filter portion 24 or just its tobacco rod portion then inserted in the tip 20 and the unit then reassembled by slipping the tubular member 12 over the land portion 32.

Figure 8:
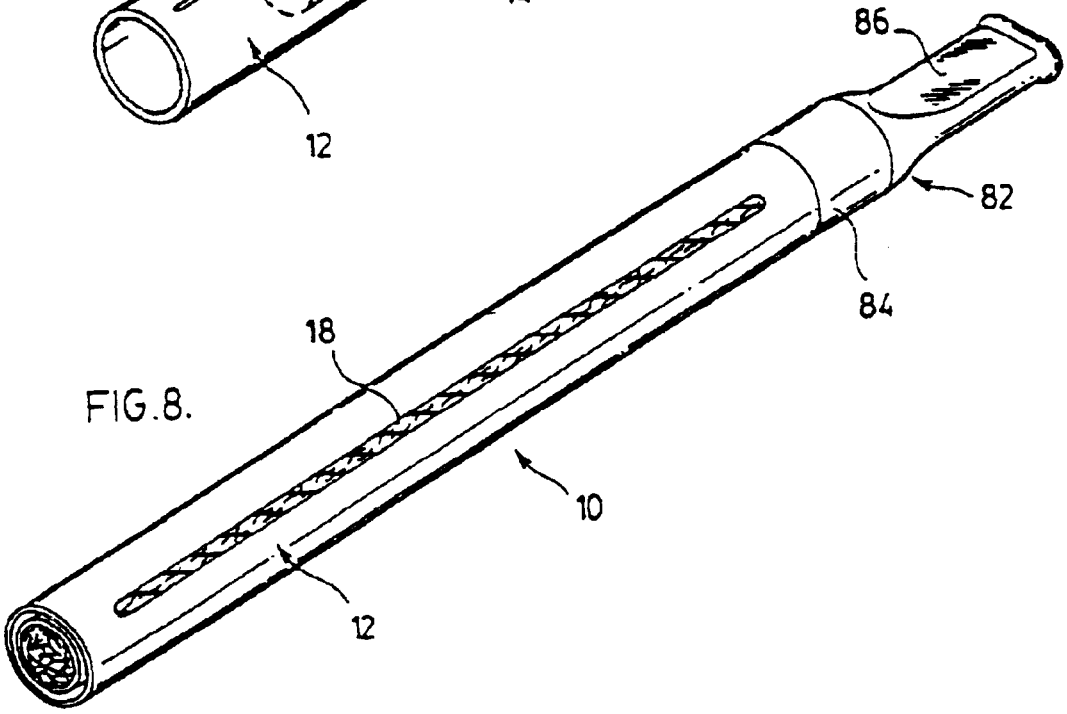
FIG. 8 is a perspective view of the device with a mouthpiece or tip.

FIG. 8 shows an alternative arrangement for the device 10 where attached to the tubular member 12 is a mouthpiece 82. The mouthpiece 82 may receive in the body portion 84, the tip of the tobacco charge and as well present a land portion onto which the tubular member 12 is slid. The tip 82 has the conventional narrowed portion 86 to feel comfortable in the smoker's mouth.

The tip 20 may resemble a normal cellulose acetate type cigarette filter having a filter plug 72 as shown in FIG. 9. The land portion 34 may have its annular end 86 inserted in tube 12 to prevent drawing into the tip 20, air from the annulus defined between cigarette 14 periphery and interior 40 of tube 12. It is also understood that it may be desirable to draw a controlled amount of air into the tip 20 which can be achieved with conventional ventilation holes or ventilation techniques used in the filter tip 20. The tip 20 has a recess or bore 73 in shoulder 34 as defined by end 86. The tobacco rod end 75 is inserted in the bore 73 to secure the tobacco rod 22 in the spiral tip 20 to form a cigarette component. The tube 12 is then assembled on land 34 to complete the smoke device 10. The device may be correspondingly disassembled to allow insertion of a new rod 22 for smoking.

Further enhancements to the structure include providing at the open end 85 of the tubular member 12, a ring 88, as shown in FIGS. 10 and 11. The ring may have an opening 90 which is approximately the same size as a diameter of the cigarette distal end 26. The ring 88, in accordance with one embodiment of the invention, is useful in retaining ashes in the tube 12 as the cigarette is smoked. The cigarette end 87 may be located slightly inwardly of the ring 88 to facilitate lighting of the cigarette in the assembled device.

Figure 12:
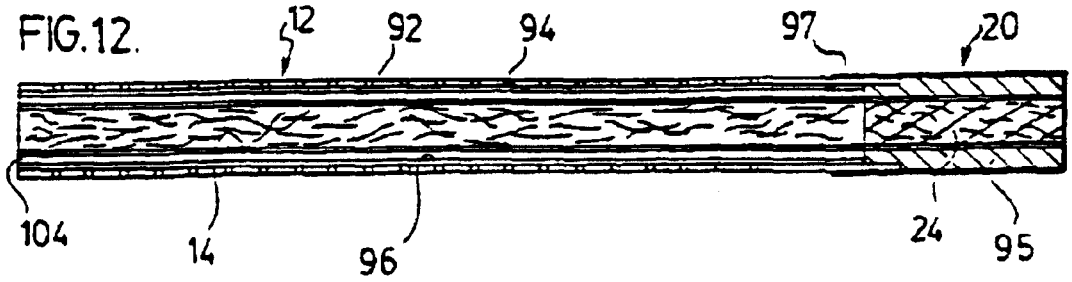
FIG. 12 is a longitudinal section of an alternative structure for the device of FIG. 1.
Figure 13:
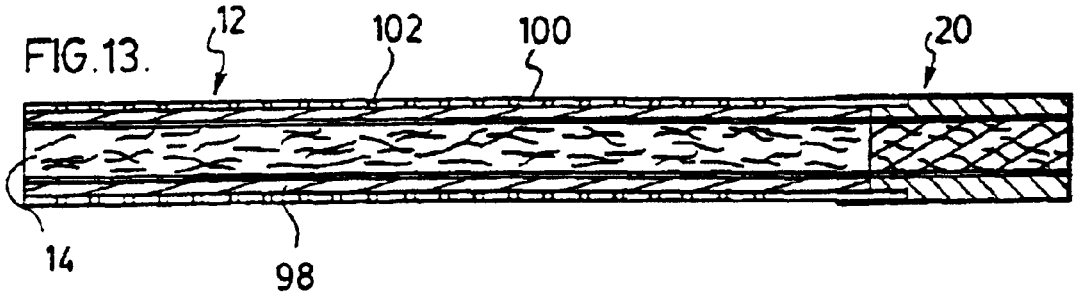
FIG. 13 is a longitudinal section of an alternative embodiment for the device of FIG. 12.

Other variations in respect of the free-burn rate control device in combination with an outer casing are shown in FIGS. 12 and 13. In FIG. 12, the tubular member 12 has an outer casing 92. The casing 92 has a plurality of openings 94 provided therein. These openings are in sufficient number and size to permit free flow of air therethrough to supply a quantity of air usually in excess of what is required for the burning cigarette. In order to control this flow of air and achieve the simultaneous sidestream smoke minimization and free-burn rate control, a thin tubular layer 96 of porous material is provided. The layer may be located on the interior surface of the porous tube 92 and optionally secured thereto. The layer 96 of porous material has a porosity which achieves the desired air flow control and hot combustion gas retention. In addition, the porous material is capable of absorbing and capturing the smoke. As with the other embodiments, when the device 10 is designed for re-use, the porous material 96 retains the captured smoke and does not release it upon lighting and smoking a fresh cigarette. Alternatively, the porous material 96 may be in the form of a replaceable tube which is inserted in the tubular element 12.

With the embodiment of FIG. 13, a considerably thicker inner layer 98 of porous material is provided. The thickness of that layer may correspond with the thickness of the tubular member 48 of FIG. 5. The outer casing 100 may be a very porous outer coating of high porosity paper, ceramic fibre, high temperature plastic and the like. As demonstrated, the outer wrapping 100 has a porosity as indicated by the openings 102 which are in sufficient number and size so as to not interfere with the functioning of the tubular porous member 98. The inner tubular member 98 contacts the outer periphery of the cigarette 14 in the same manner as that described with respect to the embodiment of FIG. 5. This is in contrast to the embodiment of FIG. 12, where the porous tubular member 96 is spaced from the periphery of the cigarette 14 to define an annulus 104 which is similar to the embodiment described in respect of FIG. 2. The function of the tubular member 98 is the same as described with respect to the embodiment of FIG. 2. The burning coal with ash portion advances inwardly of the tube. The porous material 98 controls air flow and also contains the preferred major portion of hot oxygen deprived combustion gases in the region of the burning coal to achieve the desired free-burn rate control.

Figure 15:
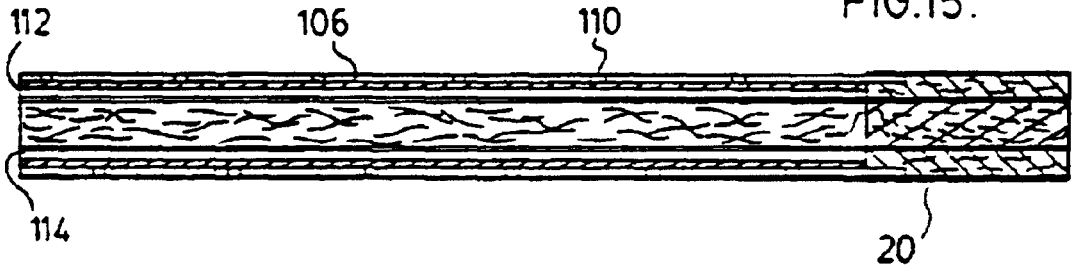
FIG. 15 is a longitudinal section of the spiral construction of FIG. 14.

With the embodiment of FIGS. 12, 13 and 15, the cigarette 14 has its filter tip 24 extending through the tip 20. The tip 20 may have a filter tip 24 receiving portion 95 which is optionally porous since it does not need to perform a filtering function. The receiving portion 95 is secured to the tube 12 by tipping paper 97.

Figure 14:
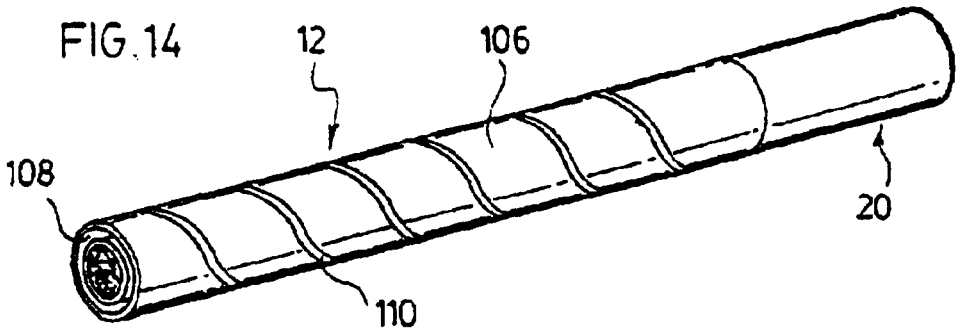
FIG. 14 is a perspective view of an alternative spiral wrap construction for the tubular member.
Figure 16:
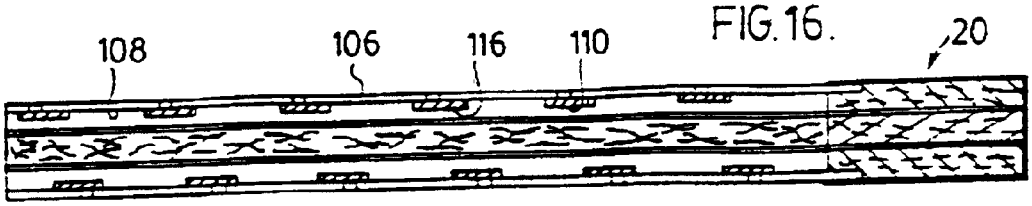
FIG. 16 is a longitudinal section of an alternative construction for the spiral configuration of FIG. 14.

As shown in FIG. 14, a further alternative embodiment for the tubular member 12 is provided. The tubular member 12 is made from a spiral wrap 106 of non-combustible material. Intermediate material is provided on the interior 108 of the spiral wrap to fill the spiral spacing 110 with a component for controlling free-burn rate. In one embodiment, as shown in FIG. 15, the spiral wrap 106 may have secured on the inside thereof, a tubular member 112 of porous material. The tubular member 112 may function in the same manner as the devices described with respect to FIGS. 12 and 13, where an annular gap 114 is provided between the tubular member 112 and the periphery of cigarette 14. Alternatively, as shown in FIG. 16, the wrap 106 may have secured to the interior surface 108 thereof a wrap 116 of porous material and which functions in the same manner as the porous material for tubular member 112. The wrap 106 may be formed of any suitable non-combustible material, preferably ceramic fibre. The tubular member 108 or inner wrap 116 is also of a non-combustible material which is porous and is preferably made of activated carbon fibre.

Figure 17:
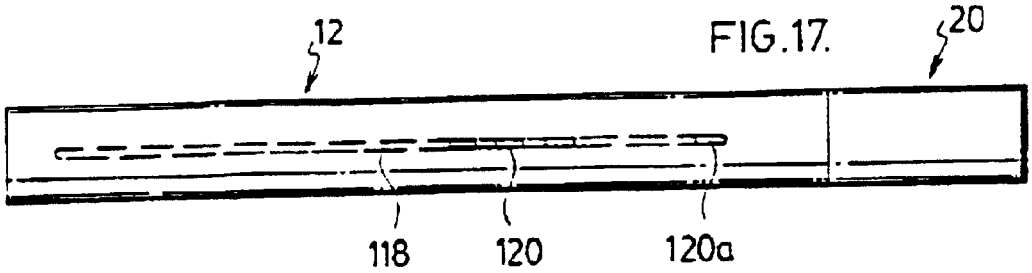
FIG. 17 is a plan view of the device with a temperature indicator.

The embodiment of FIG. 17 may have a tubular element 12 of any of the above identified constructions and on the surface thereof, a temperature indicator 118 may be provided. The temperature indicator may consist of individual cells 120 which change colour, depending upon their temperature. As the burning coal of the cigarette burns inward of the tubular element 12, the temperature in that region changes the colour of the individual cells 120 hence the smoker can visually track the movement of the coal inward of the element 12 and cease smoking of the device 10 when the last cell 120A indicates that the burning coal is almost at the filter. The temperature indicator greatly facilitates the use of the device 10 and avoids the smoker puffing on a cigarette that has extinguished in the tubular element 12 by virtue of having encountered its filter portion. It is also understood that on a single use device, the tubular element 12 may be wrapped in porous cigarette paper. As the coal of the cigarette burns inward of the tubular element 12, the cigarette paper will turn slightly off colour, thereby indicating the position of the burning coal within the tubular element 12. Alternatively, the tubular element 12 may be of a non-combustible material which changes colour as the burning coal moves inward. It is understood that the adhesive used in completing the seam for the covering of the device 10 may be of heat sensitive material. That material then changes colour as the burning coal moves inward of the tubular element 12. The wrapping may be formed of a non-combustible heat resistant material such as ceramic fibre so that the device may be re-used. The material for gluing the same, may be of a composition which is capable of repeatedly changing colour as the burning coal moves inwardly of the tubular element 12.

Figure 18:
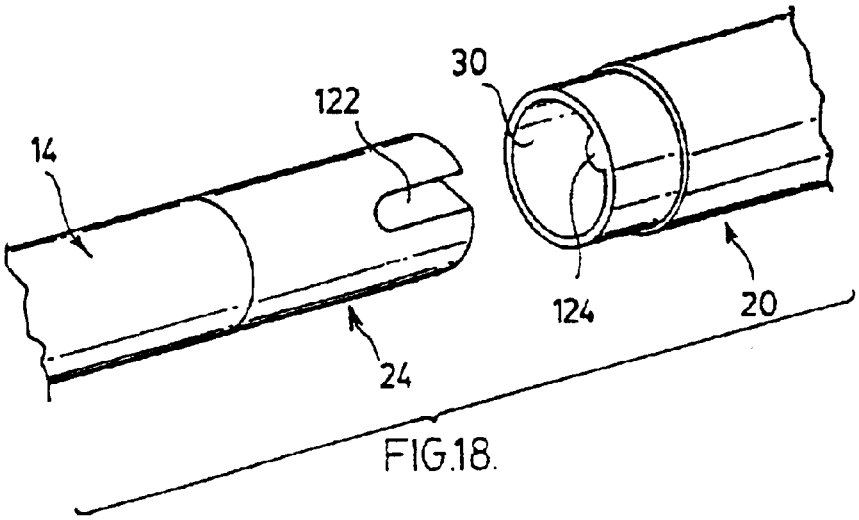
FIG. 18 is an exploded view of a cigarette tip adapted to fit a holder with detent.

In order to achieve a unique interfit of cigarette tip with holder, a mating cigarette tip configuration and holder interior may be provided, as shown in FIG. 18. A cigarette 14 has its tip portion 24 formed with a longitudinally extending recess 122. The holder tip portion 20 has a detent 124 extending longitudinally inwardly of bore 30. The shape of the recess 122 is such to form a mating fit with detent 124, and thereby ensure that only cigarettes designed for use with this holder 20 may be used in the device. Such design may be relied on to ensure, for example, that correct length of cigarette is used with the correct filter size in tip 20 or that the correct cigarette brand is used in the device.

Figure 19:
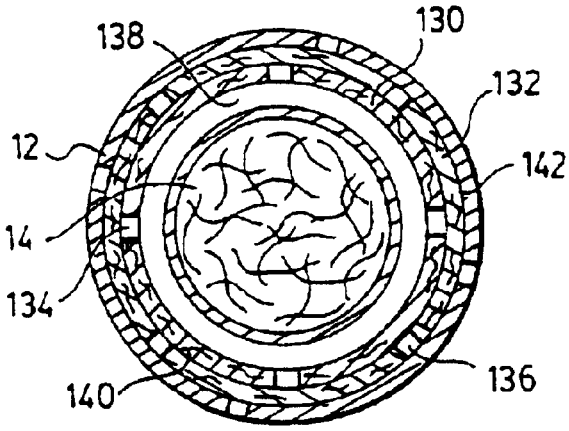
FIG. 19 is a cross-section through an alternative embodiment for the tubular element.

Another alternative embodiment for the tubular member 12 is shown in FIG. 19 where a tortuous path for the flow of air into the tubular member and for the sidestream smoke toward the exterior of the tubular member is shown. A cigarette 14 is surrounded by three concentric tubes. The first two inner tubes 130 and 132 have longitudinal slits defined therein similar to that of the tubular member 12 which is the outer tube. The inner tube 130 has its slits 134 offset from the slits 136 of the adjacent tubular member 132. An annular space 138 is provided between the cigarette periphery in the interior of tubular member 130. A thin space 140 is provided between tubular members 130 and 132 and as well a thin space 142 is provided between tubular member 132 and tubular member 12. Such narrow spacing between the tubular members provides a controlled degree of communication between the openings in the respective tubes in forming the tortuous flow paths. Tubular member 12 has positioned therein the usual matting, woven fibre or stranded fibre to provide for the free-burn rate control and sidestream smoke control. The sidestream smoke as it emanates from the burning cigarette 14 travels outwardly through slits 134 and then follows a tortuous path between tubular members 130 and 132 to travel out through the apertures 136 which are out of register with the apertures 134 and then back through the space between tubular members 132 and 12 to encounter the porous material 18 in the outer slit 16 of the tubular member 12. By providing this tortuous path of flow for the sidestream smoke, an enhanced filtration effect takes place along with further cooling so that the exterior of the tubular member 12 is comfortable to the touch and at the same time reduces order at the periphery of the cigarette.

Figure 20:
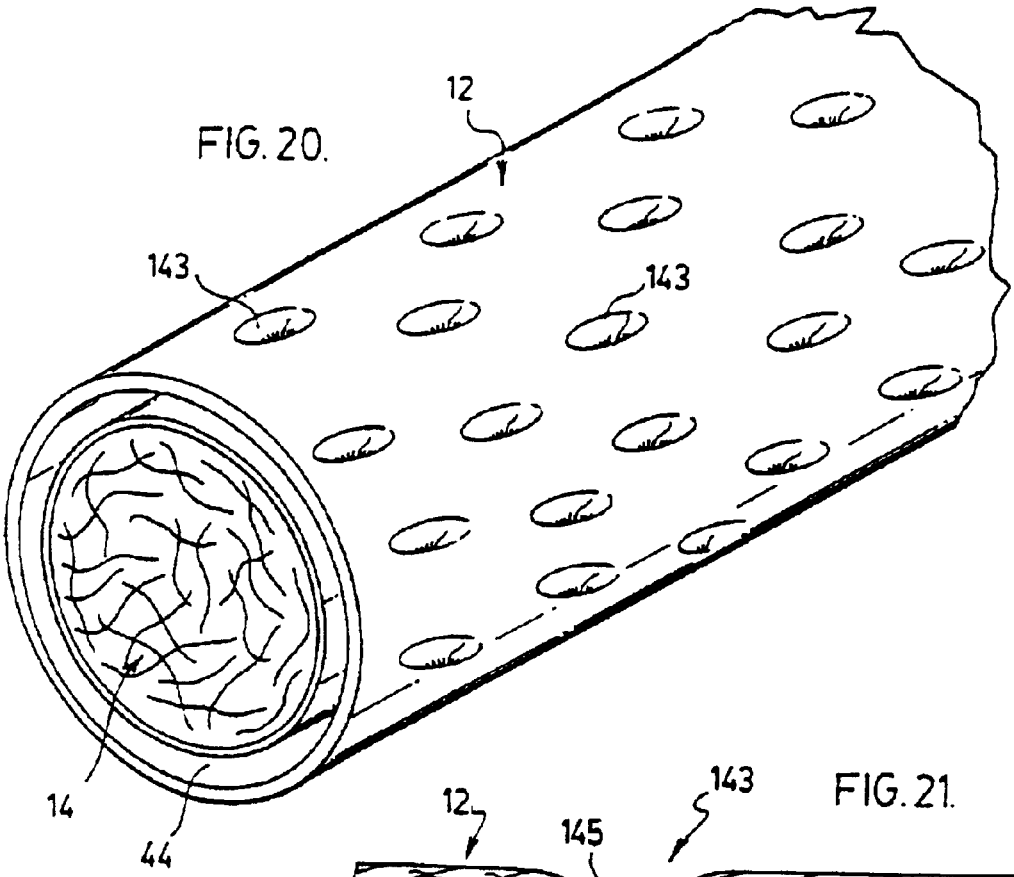
FIG. 20 is a perspective view of an alternative embodiment for the tubular element.
Figure 21:
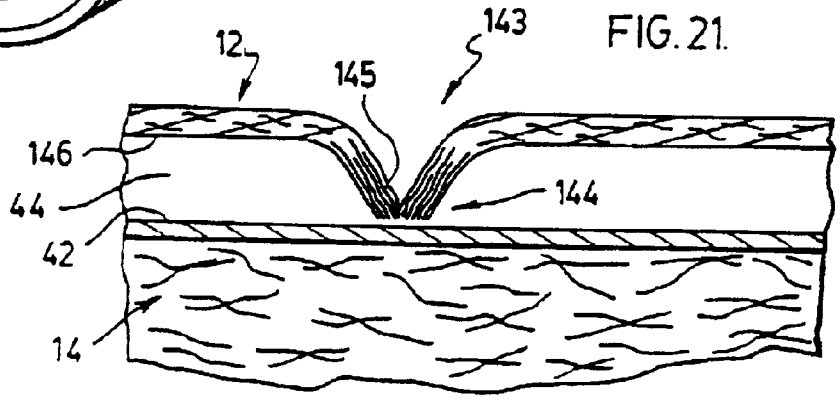
FIG. 21 is a section of FIG. 26.

An alternative embodiment for the tubular member 12 openings is shown in FIGS. 20 and 21. The tubular member 12 has the apertures 143 formed therein in a special manner to enhance sidestream smoke control while still providing the necessary free-burn rate control. This is accomplished, as shown in the section of FIG. 21, where the apertures 143 are fabricated in the tubular wall by, for example, punching or piercing the tubular member 12 to provide burrs or protrusions 144 of fibrous material which project inwardly of the inside diameter 146 of the tubular device 12. The tubular member 12 is normally of a fibrous type of material so that the burrs 144 project fibres 145 inwardly of the tube to further enhance filtration and treatment of sidestream smoke which attempts to flow outwardly through the apertures 143.

As shown in FIG. 21, the burrs 144 perform a locating feature in positioning the cigarette 14 centrally within the tubular member 12 to define gap 44. Such positioning of the cigarette within the tubular member by the burrs 144 further enhances the sidestream smoke treating feature of the burrs in that smoke needs to flow through the fibres 145 of the burrs before any vaporous products can be emitted through the apertures 143. It has been surprisingly found that by the use of this type of aperture formation in the tubular member 12, not only is the smoking sensation of the element very close to that or the same as smoking a normal cigarette, also, the smell around the periphery of the cigarette is normal and does not emit an off smell.

Figure 22:
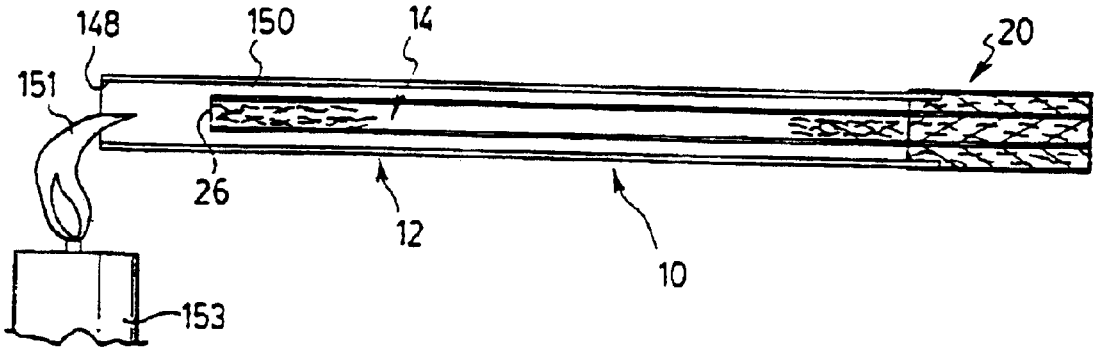
FIG. 22 is a longitudinal section view of an alternative embodiment for the tubular element having a porous wrap of ceramic sheet.

FIG. 22 shows yet another alternative embodiment for the tubular member 12 where the tubular member may be thinner or approximately the same thickness as the other tubular members of FIG. 20. The thickness is indicated by the end 148 of the tubular member. The tubular member 12 is spaced from the cigarette 14 by the annular gap 150. The thin tubular member is made up of overlapping sheets of ceramic fibrous material which has been conditioned or mildly calcined in an oven to remove by combustion most of the binder material from the ceramic fibres. The sheet then becomes porous because by combustion removal of the binder from the sheet, a mass of intercommunicating voids are provided to form the porous sheet. The very porous sheet can be formed into a tube by wrapping the sheet several times upon itself. The end result is a tubular member of very small pores which may allow escape of non-visible volatiles but at the same time performs the necessary sidestream smoke control and free-burn rate control for the burning cigarette 14. By selection of a suitable ratio for ceramic fibres to combustible binders used in making the base sheet, the heating of this material can produce the desired porosity by the controlled calcining of the formed tube which removes a desired amount of the organic binders such as cellulose. The sheet is wrapped upon itself to form the tubular member 12 which is then calcined to form matrices of communicating pores in the tubular member in providing the required porosity and pore sizing to control sidestream smoke and free-burn rate.

FIG. 22 also shows a special arrangement for the cigarette 14 in the tube 12. The end 26 of the cigarette may be spaced inwardly of the end 148 of the tube. It has been found that the cigarette 14 can be lit by drawing the hot gases of the flame 151 of the lighter 153 into the tube where the cigarette end 26 is positioned well within the tube 12. For example, the end 26 may be located up to one-half the cigarette length away from the tube end 148. The recessed positioning of the cigarette end reduces the amount of sidestream smoke which could be released on lighting the cigarette in the device 10.

Various structures have been described for the filter tip portion or mouthpiece portion of the device 10. An alternative construction for the filter tip is shown in FIGS. 23 and 24 where the filter tip 20 comprises a sleeve 160 which may be cylindrical to provide a cylindrical shoulder 162. The cylindrical tubular element 12 is friction fitted on the sleeve shoulder 162 by virtue of its interior surface 164 being approximately the same diameter as the shoulder 162. The sleeve has an annular flange 166 which defines a stop against which the end 168 of the tube abuts. Filter tipping paper 170 surrounds a thin insert 172 which withstands crushing in this area of the filter to ensure that space 190 is maintained. The tipping paper 170 and sleeve 172 may be adhered to the tubular element to complete assembly of the filter tip on the tube. Alternatively, the tubular element may be separated from the filter to facilitate insertion of a new cigarette. When it is desired to provide a degree of ventilation in the cigarette mainstream, ventilation holes may be provided in the insert 172 in the normal manner.

The sleeve 160 has a bore 174 formed therein which snugly receives on a friction fit basis, an end portion 176 of the tobacco charge 22. The friction fitting of the tubular tobacco charge in the sleeve 160 supports the tobacco charge and locates it within the tubular element 12. The sleeve 160 may have integrally formed therewith or connected thereto, a tubular porous support structure 178 which may be wire mesh. The porous tubular structure 178 supports micro-fibre material 180. The micro-fibre material may be made in accordance with the process described in applicant's Canadian patent 1,057,924; U.S. Pat. No. 3,882,877 and published international application WO 90/09741. These references describe the use of such micro-fibre material in cigarette filters. The micro-fibre material is very efficient in filtering tobacco smoke while at the same time providing a very low pressure drop as the smoke flows through the filter. The smoke enters the tubular filter 20 through the central opening 182 in the direction of arrow 184. The smoke travels radially through the first tubular filter 180, as indicated by arrows 186. It is appreciated that as the filter removes particulates from the cigarette smoke, the smoke travels further down the tubular filter 186 so that the efficiency of the filtration material is not compromised. Optionally surrounding the micro-fibre material 180 is a second tubular filter 188 which is of a second filtration material. Preferably, the second tube 188 is concentric with and overlaps the first tubular filter 180. Preferably, the second tubular filter is made of carbon and especially activated carbon to remove particulates from the smoke stream as well as modify the flavour of the cigarette smoke. The second tubular filter 188 is placed in the annular space defined between the first filter 180 and the plastic insert 172. With the second tubular filter in place, an annular space 190 is defined between the second filter and the tipping paper. The smoke flows in the continued direction of arrow 186 along the annulus 190 and around a stop 192 which has an annular array of apertures 194 which allow the smoke to flow into a plenum 196. The plenum distributes the smoke across the interior face 198 of the filter plug 200 to distribute the smoke to flow in a direction of arrows 202 through the filter plug 200. The stop 192 in this embodiment closes off the end portion 204 of the first filter tube 180 to ensure that the smoke is forced to flow through the micro-fibre filter material when someone drags on the cigarette device. This construction for the filter tip is particularly beneficial in directing the mainstream flow of smoke from the thin cigarette 14 through multiple component filter arrangement to ensure proper filtration and provide a mainstream smoke at the filter tip which is pleasing to the smoker and provides the normal expected flavour, tasted and pressure drop.

Figure 25:
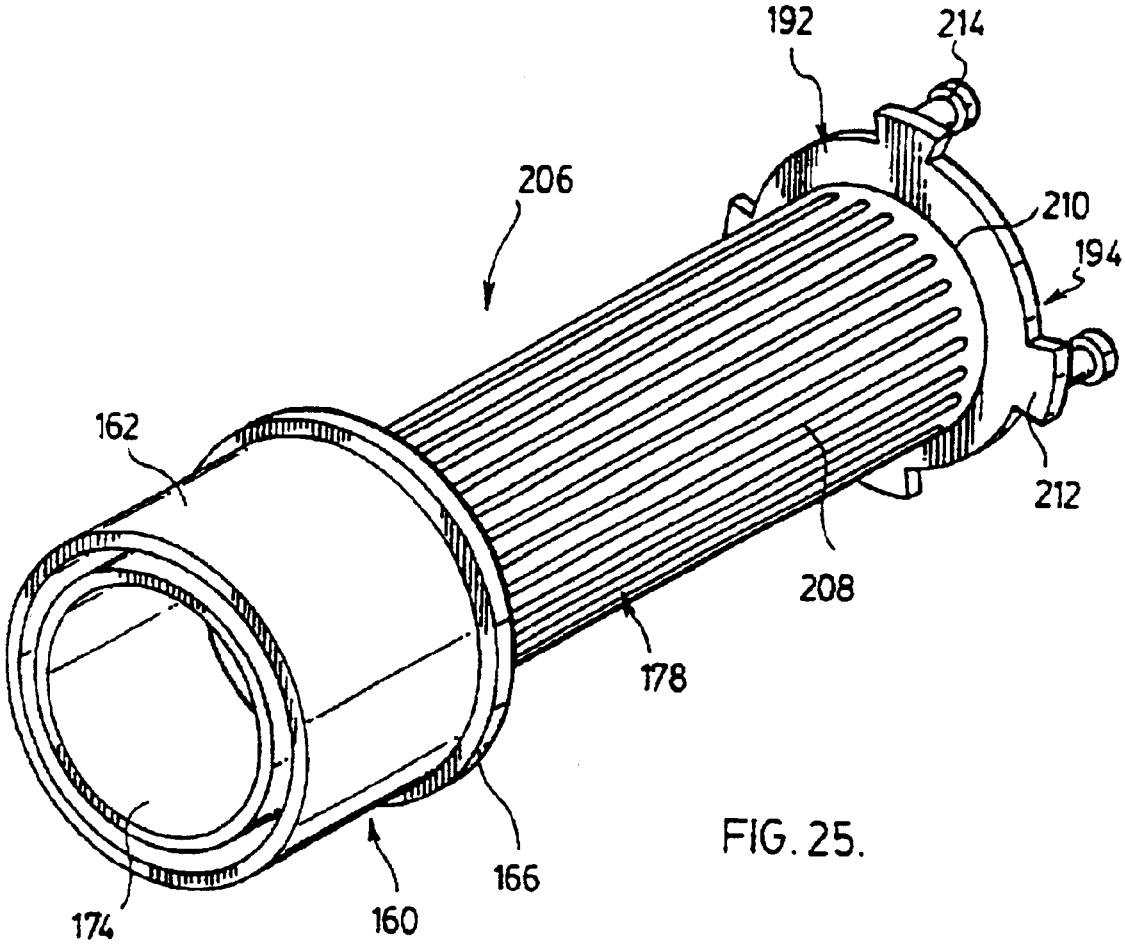
FIG. 25 is a perspective view of an injection molded component of the device of FIG. 23.

With reference to FIG. 25, a preferred embodiment in the construction of the filter tip of FIG. 23 is shown. In FIG. 25 the device for supporting the first tubular filter material which may of micro-fibre material is an injection molded element 206. The element has the sleeve 160 with the defined outer shoulder 162, the stop 166 and the inner bore 174. The support 178 for the first filter material has a plurality of slots 208 extending along its length to allow cigarette smoke passing through the opening 182 in the tubular support to pass radially through the slots 208. As noted, the stop 192 includes a planar portion 210 which blocks off the end region of the tubular support 178 for the first filter material. In addition, the stop 192 includes buttons 214 which provide a spacer for locating the filter plug 200 of FIG. 24 from the inner face 216 of the stop to provide the plenum 196, as described with respect to FIG. 24. As shown in FIG. 25, the buttons 214 are located about the periphery of the stop 192. In addition, the aperture 194 space between button supports 212 are shown through which the tobacco smoke flows in filling up the plenum 196.

As previously noted, the tobacco charge may take on the form of a tobacco rod formed in a highly porous mesh and sold under the trade-mark "Custom Cut" by Rothmans, Benson & Hedges Inc. Such tobacco rod, if smoked on its own, would be too porous to permit smoking. It is understood that the tubular member 12 may be adapted to reduce the porosity of the mesh holding the tobacco rod to render it smokeable. This may be accomplished by providing within the tubular member 12, an inner sheath into which the tobacco rod is slid or to adapt the embodiment of FIG. 5 or 13 to encase and contact the periphery of the tobacco rod to provide the necessary reduction in porosity so that the tobacco rod may be smoked. Other variations for a normally non-smokeable product include modifying the cigarette filter 24 of FIG. 2 such that the filter wrapping paper or exterior is too porous to effect any draw on the lit tobacco charge. However, when the porous filter tip 24 of cigarette 14 is inserted in the tip 20, the interior of the bore in the tip 20 of for example FIG. 12, seals off the porous filter exterior so that the cigarette becomes smokeable. Another alternative is to position a strong unfiltered wrapped tobacco rod which is too strong to smoke normally, in the tip 20 to provide the desired filtered smokeable flavour and taste.

The device surrounding the cigarette or cigar, provides a significant safety feature should the device be accidentally set down on an ignitable material. The non-combustible tubular member contains the burning coal of the cigarette and prevents direct contact of the burning coal with the potentially ignitable material. This arrangement then greatly reduces the chances of accidental fires caused by a burning cigarette. In addition, the tubular element, either by virtue of the annulus or its thickness, provides a perimeter which although hot to the touch, is not at a temperature which would burn a smoker. Although the tubular element may become warm during the smoking process, it would not be so hot as to burn the user. The tubular element ends preferably with the end of the tobacco rod and may even be flush therewith. Because the tubular element is non-combustible, a flame may be applied to the end of the device to ignite the distal end of the cigar or cigarette so that smoking may commence.

As previously noted, a further benefit in providing the various embodiments of this invention is to include catalytic material or particles which function to convert odour causing gases into substituents which have less or no odour. Depending upon the efficiency of the sidestream smoke control aspect of the device, it has been observed that the only constituents escaping through the tubular element are invisible odourless gases. It is therefore important to reduce this smell either by allowing some of the smoke constituents to emanate as invisible vapours to mask the smell or to take steps to reduce the smell so that it is not noticeable during the smoking process. As is understood, considerable amounts of odour causing gases are emitted from a burning cigarette during the normal smoking process, however, strong smells from such odour causing gases are masked by all of the other constituents of smoke which are emitted with the sidestream smoke. It has been found however that suitable catalysts which may be of the precious metals, rare earth metals and the like, and mixtures thereof either as catalysts or metals in the catalyst. Preferred metals include platinum or cerium which may be used to oxidize the odour causing gases to render them odourless. The catalyst particles may be included in various aspects of the tubular member. They may be placed in the porous material, put in the various types of openings in the tubular member and, for example, when making the matted material 18, the catalytic particles may be included in the matting. Catalytic materials may be applied to the interior or exterior of the tubular member or may be adhered to the fibrous strands which are placed in the slits of the tubular member. It is also appreciated that the catalytic material may be applied as a thin film to the interior of the tubular member or in the apertures 104 of the embodiment of FIGS. 12 and 13. The catalytic material may be included as a heat treated material in the apertures 104 to provide further sidestream and free-burn rate control as long as the catalyst is positioned in an area where it achieves the desired oxidation of the vaporous materials in the aerosols which permeate the tubular member.

The catalytic material as included in the material for making the tubular member such as with the manufacture of the matt 18, has provided significant benefits in converting odour causing invisible gases to either odourless gases or gases with an acceptable odour and at the same time, allowing one to exercise additional control in providing the required predetermined porosity in the tubular element. The advantages are particularly apparent when the catalyst is used in the manufacture of the calcined tubular members of FIG. 22. The tubular member may be formed by wrapping two or more layers of the formed ceramic precursor sheet to provide a tubular shaped member. The sheet may be formed in the usual manner by making a slurry of the ceramic precursor material which includes clays, alumina sol binders, various types of organic binders, aluminum oxide and other normal constituents usually included in a ceramic precursor. In order to prepare the sheet, this slurry with high solids content is laid out in accordance with usual paper-making processes, rolled and dried to form a sheet of ceramic precursor material. The sheet is then, as previously noted, wrapped upon itself one or more times depending upon the thickness of the sheet to provide a tubular member of a desired thickness. In the manufacture of the sheet, catalytic materials and/or catalytic precursor materials may be incorporated in the slurry and either solubilized or dispersed in the slurry whereby the catalytic material, either in the form of a catalyst or precursor is correspondingly in the sheet material when wrapped into the tubular element and during the mild calcining of the tubular element. It has been found that the presence of the catalytic material provides an additional controlling factor m achieving a desired porosity in the tubular member and as well, by virtue of its in situ presence in the tubular member, provides enhanced oxidation of the odour causing gases as they pass through the tubular element. Such enhanced oxidation is compared to coating the tubular element on the inside with a catalytic material.

Although it is believed that a variety of catalytic materials may be used such as the previously mentioned catalytic materials based on precious metals, rare earth metals and the like, which include platinum or cerium, it has been found that the preferred precursor catalytic material for incorporation in tube manufacture, is a cerium oxide catalyst precursor, namely, hydrated cerium oxide. This material may be obtained from Advanced Material Resources of Toronto, Ontario, Canada. The inclusion of the hydrated form of cerium oxide in the ceramic precursor slurry results in its crystalline structure changing during the mild calcining process. The cerium oxide is dehydrated to become an alternative crystalline cerium oxide in the calcined material, normally in the form of crystallites. During the conversion of the hydrated cerium oxide to cerium oxide catalyst it is thought that the developing cerium oxide catalyzes the oxidation, i.e., burning of the binder material, particularly when the binder is organic such as cellulosic material. It is though that the catalyzed oxidation of the binder material enhances the size of the pores being formed in the tubular element as it is calcined. By virtue of the presence of the catalytic cerium oxide, the extent of oxidizing of the cellulosic material can be controlled to provide a desired pore size in the material to achieve the desired predetermined porosity in the tubular element.

Another advantage to the in situ incorporation of the cerium oxide catalyst in the tubular element is that an enhanced oxidation of invisible odour causing volatiles is achieved to thereby reduce any unpleasant odours emanating from the cigarette construction. It has been found that the invisible volatile components include ammonia and aldehydes. The in situ presence of the cerium oxide has surprisingly, even in the presence of high levels of carbon monoxide competing for oxidation sites on the catalyst, achieved oxidation of the ammonia and aldehyde constituents converting them into odourless constituents or at least constituents which have a more normal odour associated with cigarette smoking. It is particularly surprising in view of all of the chemicals of combustion from a burning cigarette, that the cerium oxide catalyst works particularly well in neutralizing the smell of ammonia in the invisible volatiles which permeate the porous tubular member.

Although the in situ formation of the cerium oxide catalyst in the tubular element is advantageous in not only catalyzing oxidation of the volatiles but as well providing an enhanced control on the porosity of the element, it is appreciated that the cerium oxide catalyst may be applied in sintered form as a powder to the interior of or exterior of the tubular element or within the openings of the tubular element or on the matting for openings in the tubular element, as previously described with respect to the other type of catalyst.

Various aspects of the several embodiments are exemplified as follows where such specific examples are not intended to be limiting the scope of the claims.

The cigarette for the device may range in size from about 3.5 mm to 10 mm and preferably about 4 to 8 mm in diameter. Very acceptable performance has been realized with cigarettes having diameters of about 4 to 5 mm. In order to provide the desired flavour and taste in the mainstream smoke, particularly with the thinner cigarettes, it is understood that the blend of the cigarette may be modified in accordance with the blending processes described in applicant's U.S. Pat. No. 5,524,647. The packing density of the cigarette, even with the thinner cigarettes does not having to be special. Normal packing densities may employed such as in the range of 200 to 300 mg/cm$^3$. The device provides the desired number of puffs for the thinner cigarette so that there is no need to use higher or lower than normal packing densities. The cigarette may be wrapped in any suitable cigarette paper of a porosity which may be greater than porosity of the tube. The paper porosity should range from 10 to 100 Coresta units and preferably 40 to 60 Coresta units. Vanillin and other flavour additives may be incorporated in the paper. The free-burn rate of the thin cigarettes in normal smoking conditions, i.e., outside of the tube, is quite high. For example, with a 5 mm diameter cigarette with normal blend, packing density and cigarette paper, the free-burn rate is about 5 mm/minute. With the 4 mm diameter cigarette, the free-burn rate is significantly greater, namely, 8 to 10 mm/minute. This is very high considering a normal 8 mm cigarette has a free-burn rate of about 3 mM/minute. Considering that use of the device converts a thin cigarette of normal length into an 8 to 10 puff cigarette is quite surprising while maintaining desired taste and flavour for the smoker.

The physical parameters of the tube which provide these features include a porosity value for the tube in the range of about 20 Coresta units up to about 60 Coresta units. When the device is assembled, the pressure drop for the unit may range from about 0.5 cm $H_2O$ column to 25 cm $H_2O$ column and preferably 3 to 14 cm $H_2O$ column and most preferably 5 to 10 cm $H_2O$ column. The interior diameter of the tube is about 7 to 10 mm with a tube wall thickness of about 0.25 mm to about 0.5 mm. The preferred cigarette diameters are about 4 or 5 mm to provide a gap spacing of about 0.5 mm to 3 mm, preferably about 1 to 2.5 mm and most preferably about 1.5 to 2.5 mm. During use with this range of gap spacing between cigarette and tube, the cigarette attains a temperature of about 600 to 800° C. during puff and about 400 to 600° C. during idle. The tube is at a considerably lower temperature in the range of about 120° to 200° C. The tube external temperature is preferably wrapped in normal cigarette paper having a porosity of 10 to 100 Coresta units and preferably 40 to 80 Coresta units where the porosity of the paper should be greater than that of the tube to ensure the paper does not interfere with tube porosity factor controlling free-burn rate. It has been found that if a catalytic material, such as, cerium oxide is applied to the outside of the tube, the combustion of the paper is catalyzed so that there is greater paper discoloration at each puff to indicate clearly the location of the burning coal in the tube. With this range of porosities for the tube and paper where the porosity is somewhat uniform across the material, no visible sidestream smoke passes through the tube only invisible volatiles pass which can be treated in the presence of catalyst to convert the gases to odourless constituents.

The preferred cigarette filter construction of FIG. 24, has a very low pressure drop, usually one-half the pressure drop of a normal filter, namely in the range of about 1 to 3.

The preferred catalytic material is a mildly calcined hydrated form of cerium oxide ($Ce_2O_3 \times H_2O$) which is available from the aforementioned AMR of Toronto. The catalyst may be incorporated into the sheet manufacture where a slurry composition of about 90 to 95% by weight water includes inorganic materials of glass fibres and micro-fibres, clay, talcs and the like and organic binders of acrylnitriles and acrylic based latex. In addition, to hold paper strength before calcining, the slurry may include cellulosic fibre. In the finished dried paper, the inorganics may comprises up to 90% by weight of the paper. The paper normally has a thickness of 5 to 10 mil and is wrapped upon itself 2 to 3 times in making the tube. The tube is mildly calcined by heat treating in an oxidizing atmosphere at a first phase temperature of about 220 to 260° C. and a second phase temperature of 400° C. to 600° C. This stagewise heating ensures a release of the volatiles without puffing the material. The catalyst may be incorporated on a dry sheet weight basis of about 0.5 to 10%. Preferably the catalyst precursor is incorporated at about 1 to 5% by weight and most preferably 1 to 3% by weight. With suitable organic loadings a desired porosity in the tube is achieved when the pore size is capable of restricting flow to control free-burn rate and contain the hot combustion gases in the tube. Preferred densities of the paper have a density of about 0.70 gm/cm$^3$ to 0.80 gm/cm$^3$ which is achieved with a higher organic loading in the slurry.

In a preferred embodiment of the invention the tubular element may have an exterior dimension the same as that of a conventional cigarette so that the overall appearance of the device with the tip in place is that of a conventional cigarette. By virtue of free-burn rate control, the thin non-conventional cigarette used within the device may have considerably less tobacco perhaps up to three quarters less tobacco, and in accordance with a preferred embodiment of the invention may have two-thirds less tobacco. The free-burn rate control ensures that the cigarette, during its idle period, burns sufficiently slow that the usual number of puffs are obtained from the device of this invention corresponding to that obtained from a conventional cigarette. The significant reduction in the amount of tobacco used which would normally be waste in a conventional size cigarette, now provides a significant cost saving in cigarette manufacture while still realizing all of the other advantages and features of a conventional cigarette.

Preferred embodiments of the invention have been described herein. It is understood that variations may be made thereto without departing from the spirit of the invention or the scope of the appended claims.

It is claimed:

1. A device for minimizing cigarette sidestream smoke and reducing free-bum rate of a burning cigarette in combination with a filter tip, a) said device comprising:

i) a non-combustible porous tubular element encasing an effective length of a tobacco charge of a cigarette located in said tubular element, said tubular element having an open end adjacent a distal end of said cigarette to permit lighting of the cigarette distal end and to permit ingress of air while said tobacco charge is burning; and ii) said tubular element having a predetermined porosity along at least its length which encases said effective length of said tobacco charge for both minimizing sidestream smoke emission from the tobacco charge when burning and reducing free-burn rate of the tobacco charge when burning to increase number of puffs from the tobacco charge when burning; and b) said filter tip comprising an inlet end and an outlet end, said inlet end having an annular sleeve with a central bore to receive an end of said cigarette, said annular sleeve having an outer shoulder onto which said tubular element is friction fitted, said central bore being in communication with a first inner tube of a first filter material, said first inner tube having a closed end opposite an end of said first inner tube in communication with said sleeve central bore, an annular space being provided outside of said first inner tube, a filter plug provided downstream of said annular space and filling said outlet end of said filter tip, a plenum between said filter plug and said first inner tube for transferring filtered smoke from said annular space to said filter plug.

2. The device in combination with the filter tip of claim 1 wherein said effective length of said tobacco has a diameter in the range of about 4 to about 6 mm.

3. The device in combination with the filter tip of claim 1 wherein a second tube of a second filter material is concentrically located in said annular space about said first tube.

4. The device in combination with the filter tip of claim 3 wherein said filter materials of said first and second tubes is are selected from a group of materials consisting of cellulosic material, glass ceramic or carbon fibre matting material, activated charcoal material, micro-fibre material and any of said materials incorporating a catalytic material.

5. The device in combination with the filter tips tin of claim 1 having an annulus between an interior surface of said tubular element and cigarette periphery, said annulus defining a gap spacing of about 0.5 mm to about 3 mm.

6. The device in combination with the filter tip of claim 1 wherein the cigarette in said tubular element is inherently unsmokeable and becomes smokeable when inserted in said tubular element.

7. The device in combination with the filter tip of claim 1 wherein the cigarette in said tubular element has a filter element which is sufficiently porous to render the cigarette inherently unsmokeable and becomes smokeable when inserted in a filter tip portion of said tubular element.

8. The device in combination with the filter tip of claim 1 wherein said open end of said tubular element is open while said cigarette is smoked and said open end is adjacent a distal end of said cigarette.

9. The device in combination with the filter tip of claim 1 wherein said predetermined porosity for said tubular element:

a) retains around a burning ember of said cigarette oxygen deprived combustion gases within said tubular element to reduce rate of combustion and minimizes release of smoke particles through said porous tubular element; and b) restricts inward flow of air to reduce free-bum rate of said cigarette.

* * * * *